US005627557A

United States Patent [19]

Yamaguchi et al.

[11] Patent Number: 5,627,557

[45] Date of Patent: May 6, 1997

[54] DISPLAY APPARATUS

[75] Inventors: Akira Yamaguchi, Soraku-gun; Yutaka Ishii, Nara; Yoshitaka Yamamoto, Yamatokoriyama; Tomoaki Toichi, Tenri, all of Japan

[73] Assignee: Sharp Kabushiki Kaisha, Osaka, Japan

[21] Appl. No.: 107,895

[22] Filed: Aug. 18, 1993

[30] Foreign Application Priority Data

| | | | |
|---|---|---|---|
| Aug. 20, 1992 | [JP] | Japan | 4-221774 |
| Aug. 20, 1992 | [JP] | Japan | 4-221775 |
| Aug. 20, 1992 | [JP] | Japan | 4-221776 |
| Jul. 26, 1993 | [JP] | Japan | 5-184189 |

[51] Int. Cl.[6] ..... G09G 3/36

[52] U.S. Cl. ..... 345/90; 345/92; 345/96

[58] Field of Search ..... 345/87, 90, 92, 345/96, 205; 359/55, 57, 59

[56] References Cited

U.S. PATENT DOCUMENTS

| | | | |
|---|---|---|---|
| 4,432,610 | 2/1984 | Kobayashi et al. | 345/90 |
| 4,471,347 | 9/1984 | Nakazawa et al. . | |
| 4,532,506 | 7/1985 | Kitazima et al. | 345/90 |
| 4,781,437 | 11/1988 | Shields et al. | 359/57 |
| 4,870,396 | 9/1989 | Shields | 345/90 |
| 5,111,195 | 5/1992 | Fukuoka et al. | 345/94 |
| 5,165,075 | 11/1992 | Hiroki et al | 345/92 |
| 5,194,974 | 3/1993 | Hamada et al. | 359/59 |

FOREIGN PATENT DOCUMENTS

| | | | |
|---|---|---|---|
| 0079496 | 5/1983 | European Pat. Off. . | |
| 55-62480 | 10/1980 | Japan . | |
| 56-83781 | 8/1981 | Japan . | |
| 57-31159 | 2/1982 | Japan . | |
| 64-5282 | 1/1989 | Japan . | |
| 2-245741 | 10/1990 | Japan . | |
| 2-272521 | 11/1990 | Japan . | |
| 3-77922 | 4/1991 | Japan . | |
| 3-77915 | 4/1991 | Japan . | |
| 403257427 | 11/1991 | Japan | 345/92 |
| 4-190330 | 8/1992 | Japan . | |
| 4-310925 | 11/1992 | Japan . | |
| 5-93922 | 4/1993 | Japan . | |

*Primary Examiner*—Mark R. Powell
*Assistant Examiner*—Matthew Luu
*Attorney, Agent, or Firm*—Nixon & Vanderhye P.C.

[57] ABSTRACT

A display apparatus according to this invention includes a plurality of pixels, each of which is supplied with a pixel data; a pixel capacitance for accumulating an electric charge in accordance with the pixel data; a holding capacitance provided to each of the pixels to hold the pixel data; and a buffer amplifier for supplying the electric charge to the pixel capacitance in accordance with the voltage of the holding capacitance. Another display apparatus of this invention includes a plurality of pixels, each of which is supplied with a pixel data; a pixel capacitance for accumulating an electric charge in accordance with the pixel data; a first holding capacitance provided to each of the pixels in order to hold the pixel data; a display changing circuit which is controlled to be turned on/off by a display changing signal; a second holding capacitance which is supplied with the electric charge by the first holding capacitance via the display changing circuit; and a buffer amplifier for supplying the electric charge to the pixel capacitance in accordance with the voltage of the second holding capacitance.

20 Claims, 21 Drawing Sheets

DISPLAY APPARATUS

BACKGROUND OF THE INVENTION

1. Field of the Invention:

The present invention relates to a display apparatus of an active matrix driving system.

2. Description of the Related Art:

A display apparatus of an active matrix driving system comprises a plurality of scanning signal lines, a plurality of data signal lines, and pixels provided to the respective intersections of the scanning signal lines and the data signal lines. Each pixel includes, as shown in FIG. 29, a switching element 101 and a pixel capacitance $C_P$. The pixel capacitance $C_P$ includes two electrodes and a display medium therebetween, one of which is connected to a common line 104. The switching element 101 is made of a TFT (thin film transistor). A data signal line 102 and the other of the electrodes of the pixel capacitance $C_P$ are connected to each other via the drain and source terminals of the TFT. The gate terminal of the TFT in the switching element 101 is connected to a scanning signal line 103. Therefore, when the scanning signal line 103 is activated, the switching element 101 is turned on, thereby transferring a pixel data on the data signal line 102 to the pixel capacitance $C_P$ as an electric charge. In this manner, an image based on the pixel data is displayed. Even after the switching element 101 is turned off, an electric field is applied to the display medium by the electric charge accumulated in the pixel capacitance $C_P$, and therefore, the displayed image is maintained.

However, a leak resistor R having a comparatively small resistance is actually present in parallel with the pixel capacitance $C_P$ as is shown in FIG. 30. Therefore, the electric charge accumulated in the pixel capacitance $C_P$ leaks through the leak resistor R as a leak current. In addition, since the capacity of the pixel capacitance $C_P$ is generally as small as 0.1 pF or less, the amount of the electric charge accumulated in the pixel capacitance $C_P$ is small as shown in FIG. 31. When this small amount of the electric charge leaks as a leak current, the voltage is largely decreased. As a result, the electric charge in the pixel capacitance $C_P$ is gradually lost by the leak current and the voltage is largely decreased during the data-holding period between writing periods, when the switching element 101 is on and the electric charge based on The pixel data is accumulated in the pixel capacitance $C_P$. Such decrease in the voltage of the pixel capacitance $C_P$ during the data-holding period causes a flicker, that is, visual variation in the displayed image, thereby degrading the display quality.

A liquid crystal display apparatus is generally driven by a so-called alternating driving method, in which The electric field whose polarity is alternately changed is applied to the pixel capacitance $C_P$ so as to prevent the degradation of the liquid crystal. Also in this alternating driving method, the voltage of the pixel capacitance $C_P$ is decreased by a leak current during the data-holding periods of a positive field and a negative field as shown in FIG. 32, resulting in the same problem of the degradation of the display quality.

As a method for solving this problem, a sample and hold circuit as shown in FIG. 33 is provided to each pixel. This method is disclosed in Japanese Laid-Open Patent Publication No. 3-77922. In this method, when the switching element 101 is turned on, the pixel data is first supplied to a holding capacitance $C_H$ (for sampling), and when the switching element 101 is turned off, the electric charge based on the pixel data is held in the holding capacitance $C_H$ (for holding). Then, a transistor 105 supplies an electric charge to the pixel capacitance $C_P$ through a source line 106 in accordance with the voltage of the holding capacitance $C_H$. In this circuit, a capacitance with a small leak current can be used as the holding capacitance $C_H$ because it is merely a capacitance element. The transistor 105 is a N-channel MOSFET to which the voltage of the holding capacitance $C_H$ is input. This transistor 105 together with the pixel capacitance $C_P$ as a load forms a voltage follower circuit as a buffer amplifier. Therefore, the transistor 105 can supply a positive electric charge in accordance with the voltage of the holding capacitance $C_H$ to the pixel capacitance $C_P$ without losing the electric charge of the holding capacitance $C_H$. The pixel capacitance $C_P$ is charged so as to have a voltage lower than the voltage of the holding capacitance $C_H$ by the threshold voltage of the transistor 105. Therefore, in the pixel shown in FIG. 33, the supplied pixel data is thoroughly held by the holding capacitance $C_H$, and the electric charge based on this pixel data can be continuously supplied to the pixel capacitance $C_P$ by the switching transistor 105. Therefore, the voltage in the pixel capacitance $C_P$ is prevented from reducing during the data holding period, and the degradation in the display quality is avoided.

However, in the circuit as is shown in FIG. 33, the buffer amplifier using the transistor 105 can be operated merely unidirectionally, i.e., it only supplies a positive electric charge to the pixel capacitance $C_P$. Therefore, when a pixel data with a smaller amount of an electric charge than that of the previously supplied pixel data is supplied, the pixel capacitance $C_P$ disadvantageously continues to hold the previous electric charge.

Moreover, in a liquid crystal display apparatus of the alternating driving, the buffer amplifier only comprising such a unidirectional transistor 105 can not supply a negative electric charge to the pixel capacitance $C_P$. Therefore, such a buffer amplifier can not be used in the negative field. Thus, it is impossible to provide a practical display apparatus.

SUMMARY OF THE INVENTION

The display apparatus of this invention comprises a plurality of pixels, each of which is supplied with a pixel data; a pixel capacitance for accumulating an electric charge in accordance with the pixel data; a holding capacitance provided to each of the pixels to hold the pixel data; and a buffer amplifier for supplying the electric charge to the pixel capacitance in accordance with a voltage of the holding capacitance.

Alternatively, the display apparatus of this invention comprises a plurality of pixels, each of which is supplied with a pixel data; a pixel capacitance for accumulating an electric charge in accordance with the pixel data; a first holding capacitance provided to each of the pixels to hold the pixel data; a display changing circuit which is controlled to be turned on/off by a display changing signal; a second holding capacitance which is supplied with the electric charge by the first holding capacitance via the display changing circuit; and a buffer amplifier for supplying the electric charge to the pixel capacitance in accordance with a voltage of the second holding capacitance.

In one embodiment, the buffer amplifier is a bidirectional amplifier for supplying positive and negative charges to the pixel capacitance in accordance with a voltage of the second holding capacitance.

In one embodiment, the display apparatus further comprises a charging load circuit having a load connected in parallel with the pixel capacitance, and the pixel capacitance is supplied with the positive and negative electric charges by the bidirectional amplifier, and the positive and negative electric charges passes through the charging load circuit via the load.

In one embodiment, the charging load means is connected in parallel with the pixel capacitance during a charge supply period including at least a predetermined period from a start of supplying the positive and negative electric charges based on a new pixel data from the bidirectional amplifier to the pixel capacitance, and the display apparatus further comprises a charging load control circuit for cutting off the charging load circuit from the pixel capacitance during a period except for the charge supply period.

In one embodiment, the display apparatus further comprises a refresh circuit which is controlled to be turned on/off by a refresh signal, wherein the pixel capacitance is connected to a power supply for discharging via the refresh circuit.

In one embodiment, the display apparatus further comprises a responsive recovery circuit for repeatedly applying positive and negative voltages alternately to the pixel capacitance by a response recovery signal.

In one embodiment, a capacitance of the second holding capacitance is sufficiently smaller than a capacitance of the first holding capacitance.

In one embodiment, the display apparatus further comprises a second buffer amplifier connected between the first holding capacitance and the second holding capacitance.

In one embodiment, the display apparatus further comprises a preventing means connected between a common line and a ground line, both of which are connected to the buffer amplifying means, for preventing a current flowing between the common line and the ground line through the buffer amplifying means.

In one embodiment, all the transistors used in an area where the plurality of the pixels are formed are of one kind selected from the group consisting of P-channel and N-channel.

In one embodiment, the display apparatus further comprises a pixel data selecting means provided between a switching element and a data line for supplying the pixel data, and the switching element is connected between the first holding capacitance and the data line.

In one display apparatus according to the present invention, a pixel data supplied to each pixel is once held by a holding capacitance. Since the holding capacitance is merely a capacitance element, a capacitance with an extremely small leak current can be used as the holding capacitance unlike a pixel capacitance used for display. A bidirectional amplifier supplies a positive or negative electric charge to the pixel capacitance in accordance with the voltage of the holding capacitance holding the pixel data. Since the bidirectional amplifier is a buffer amplifier having a large input impedance and a small output impedance, it can continue to supply an electric charge to the pixel capacitance in accordance with the holding capacitance without losing the electric charge held in the holding capacitance. Moreover, when the voltage of the holding capacitance is higher than the voltage of the pixel capacitance, the bidirectional amplifier supplies a positive electric charge to the pixel capacitance. When the voltage of the holding capacitance is lower than the voltage of the pixel capacitance, the bidirectional amplifier supplies a negative electric charge to the pixel capacitance. Therefore, the supplied pixel data is thoroughly held by the holding capacitance in each pixel, and the decrease in the electric charge in the pixel capacitance due to a leak current can be compensated by the bidirectional amplifier. In this manner, a clear display can be maintained for a long period of time. Moreover, the bidirectional amplifier can supply positive and negative electric charges. Therefore, even when the amount of the electric charge in accordance with a new pixel data is smaller than that of the previous pixel data, or when positive and negative charges in accordance with pixel data are alternately supplied, the electric charge in accordance with the new pixel data is thoroughly supplied to the pixel capacitance.

Alternatively, in another display apparatus of this invention, a pixel data supplied to each pixel is first held by a first holding capacitance. When a display changing circuit is turned on by activating a display changing signal, the electric charge is supplied from the first holding capacitance holding the pixel data to a second holding capacitance, and a bidirectional amplifier supplies a positive or negative electric charge to the pixel capacitance in accordance with the voltage of the second holding capacitance. Accordingly, during the writing period in which the supplied pixel data is being accumulated in the first holding capacitance, the bidirectional amplifier continues to supply an electric charge to the pixel capacitance in accordance with the voltage of the second holding capacitance. As a result, a display based on the previous pixel data is maintained during this period.

Alternatively, in still another display apparatus of this invention, a larger current than an inherent leak current from a pixel capacitance flows through a charging load circuit, which is connected in parallel with the pixel capacitance. When such a current flows through the charging load circuit, the voltage of the pixel capacitance is always maintained at a value which is less or more than the value of an input voltage toward the value of a common voltage by the value of the threshold voltage or more. Therefore, the transistor as an output means is not completely turned off, thereby ensuring a voltage adjusting function of the bidirectional amplifier. Accordingly, the voltage of the pixel capacitance is stabilized, thereby maintaining a further clear display for a long period of time.

Moreover, when a refresh circuit is turned on by activating a refresh signal, the pixel capacitance is directly connected to a power source. Therefore, the electric charge in the pixel capacitance can be precharged or discharged by a buffer amplifier. As a result, if this precharge or discharge is conducted when a new pixel data is held by the holding capacitance, the electric charge in accordance with the new pixel data can be supplied to the pixel capacitance. Therefore, although the buffer amplifier is a unidirectional circuit merely for supplying a positive or negative electric charge, even when the amount of the electric charge in accordance with a new pixel data is smaller than that of the previous pixel data, or when a positive and negative electric charges in accordance with pixel data are alternately supplied, the electric charge in accordance with the new pixel data is thoroughly supplied to the pixel capacitance.

Furthermore, the responding property of a liquid crystal can be recovered, when a positive and negative electric field is alternately applied to the pixel capacitance repeatedly at a rate of a cutoff frequency or faster by sending a response recovery signal to a response recovery circuit. If the response recovery circuit finally applies a positive or negative voltage to the pixel capacitance, the pixel capacitance can be precharged or discharged to a predetermined voltage. Therefore, if a voltage is applied to the pixel capacitance by the response recovery circuit when a new pixel data is held by the holding capacitance, the responding property of the pixel capacitance is recovered as well as an electric charge in accordance with the new pixel data can be thoroughly supplied to the pixel capacitance.

In a circuit including the second holding capacitance, the electric charge is distributed to both the first and the second holding capacitances, thereby degrading the voltage of the first holding capacitance holding the pixel data. In order to minimize the degradation in the voltage, the capacity of the second holding capacitance should be sufficiently smaller than the capacity of the first holding capacitance. Further, when another buffer amplifier is disposed between the first and the second holding capacitances, the electric charge in accordance with the voltage of the first holding capacitance can be supplied to the second holding capacitance without losing the electric charge of the first holding capacitance.

Thus, the invention described herein makes possible the advantages of (1) providing a display apparatus in which pixel data are thoroughly held so as to maintain a clear display for a long period of time; (2) providing a display apparatus in which pixel data whose level and polarity are successively varied are thoroughly held so as to maintain a clear display for a long period of time; and (3) providing a liquid crystal display apparatus in which the responding property of a liquid crystal is prevented from degrading.

These and other advantages of the present invention will become apparent to those skilled in the art upon reading and understanding the following detailed description with reference to the accompanying figures.

DESCRIPTION OF THE PREFERRED EMBODIMENTS

Figure 1:
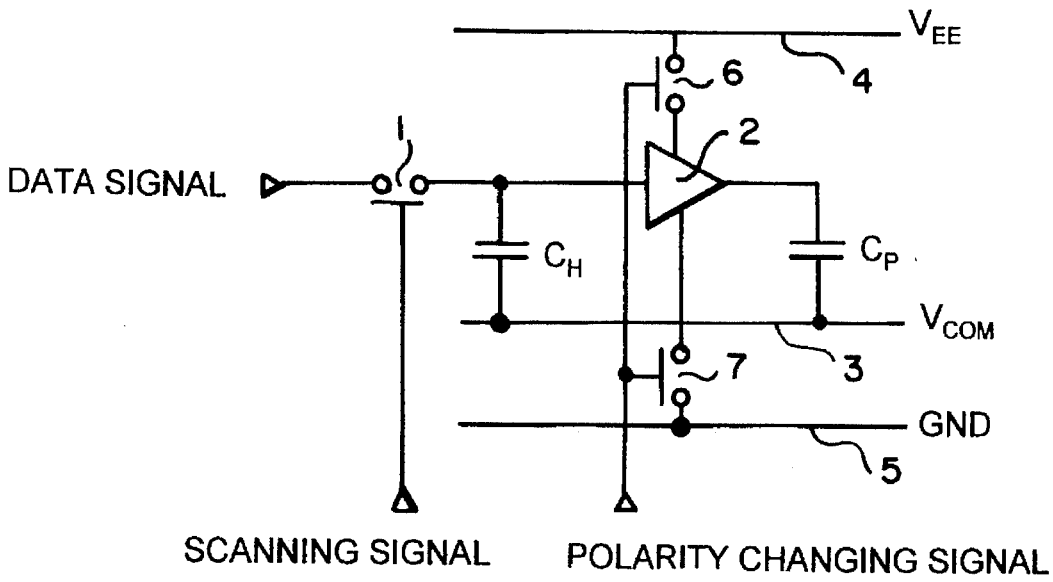
FIG. 1 is a circuit block diagram for the structure of a pixel according to Example 1 of this invention.

The present invention will now be described by way of examples referring to the accompanying drawings. Like reference numerals are used to refer to like elements throughout.

Example 1

Figure 2:
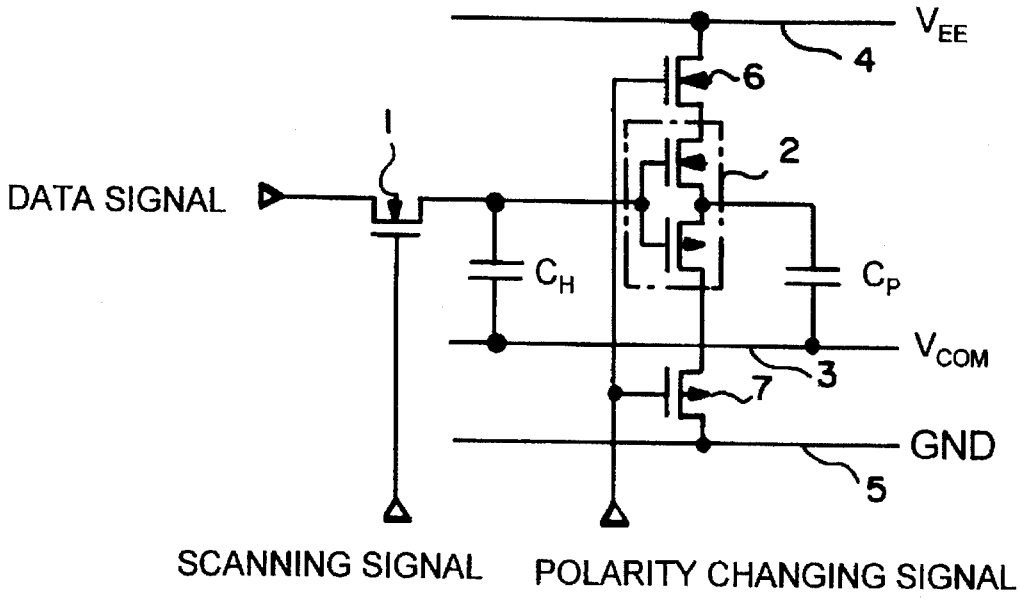
FIG. 2 is a specific circuit diagram of the pixel of FIG. 1.

FIG. 1 is a circuit block diagram for a pixel of this example and FIG. 2 is a specific circuit diagram for the pixel of FIG. 1.

Each pixel of a liquid crystal display apparatus of this example has, as shown in FIG. 1, a sample and hold circuit, i.e., a circuit including a holding capacitance $C_H$ formed on a substrate as a capacitance element and a pixel capacitance $C_P$ including a liquid crystal provided as a display element. To one electrode of the holding capacitance $C_H$ is supplied a data signal via a switching element 1. This electrode of the holding capacitance $C_H$ is also connected to an input terminal of a bidirectional amplifier 2. The switching element I is a circuit element which is controlled to be turned on/off by a scanning signal, and is formed, for example, as a N-channel MOSFET as is shown in FIG. 2. The output terminal of the bidirectional amplifier 2 is connected to one electrode of the pixel capacitance $C_P$. The other electrodes of the holding capacitance $C_H$ and the pixel capacitance $C_P$ are connected to a common line 3.

The power sources of the bidirectional amplifier 2 are connected to a high voltage source line 4 and a ground (low voltage source) line 5 via switching elements 6 and 7, respectively. The switching element 6 is a circuit which is turned on and connects the power source of the bidirectional amplifier 2 to the high voltage source line 4 when a polarity changing signal indicates a positive field. The polarity changing signal is a signal output from a control circuit (not shown) for indicating the polarity of a data signal supplied in the alternating driving of the liquid crystal display apparatus. In the circuit shown in FIG. 2, the switching element 6 is formed by a N-channel MOSFET and is on when the polarity changing signal is at a high level. The switching element 7 is a circuit which is on and connects the bidirectional amplifier 2 to the ground line 5 when the polarity changing signal indicates a negative field. In the circuit shown in FIG. 2, the switching element 7 is formed by a P-channel MOSFET and is on when the polarity changing signal is at a low level.

The bidirectional amplifier 2 is a buffer amplifier with a large input impedance and a small output impedance. In the circuit shown in FIG. 2, the bidirectional amplifier 2 is formed by a N-channel MOSFET and a P-channel MOSFET, and can supply positive and negative electric charges. When the potential of the high voltage source line 4 is taken as $V_{EE}$ and the potential of the ground line 5 is taken as GND, the potential $V_{COM}$ of the common line 3 is settled at an approximately medium value between the $V_{EE}$ and the GND. Therefore, when the voltage of the holding capacitance $C_H$ is positive with regard to the potential $V_{COM}$, the bidirectional amplifier 2 supplies a current from the high voltage source line 4 to charge the pixel capacitance $C_P$. When the voltage of the holding capacitance $C_H$ is negative with regard to the potential $V_{COM}$, a current is drawn from the bidirectional amplifier 2 to the ground line 5 to discharge the pixel capacitance $C_P$. Thus, the pixel capacitance $C_P$ is settled to have a voltage in accordance with the voltage of the holding capacitance $C_H$.

In each pixel having the above-mentioned structure, the switching element 1 is turned on by activating a scanning signal, thereby supplying a data signal of a pixel data to the holding capacitance $C_H$ (for sampling) and holding the data signal by the holding capacitance $C_H$ by turning off the switching element 1 (for holding). Therefore, the switching element 1, the holding capacitance $C_H$ and the bidirectional amplifier 2 form a sample and hold circuit. Since the holding capacitance $C_H$ is formed as a capacitance element, a leak current is scarcely caused. Therefore, even a holding capacitance $C_H$ having a capacity of 1 pF or less can thoroughly hold an electric charge for about ten-odd ms. The data signal is supplied, while alternately changing the polarity thereof with respect to the common line 3. The polarity changing signal also indicates the polarity of the supplied data signal. Therefore, when the data signal is held by the holding capacitance $C_H$, the switching element 6 is turned on in the positive field, thereby charging the pixel capacitance $C_P$ until the bidirectional amplifier 2 has a voltage in accordance with the voltage of the holding capacitance $C_H$. The switching element 7 is turned on in the negative field, thereby discharging the pixel capacitance $C_P$ until the bidirectional amplifier 2 has a voltage in accordance with the voltage of the holding capacitance $C_H$. In the circuit shown in FIG. 2, since all the MOSFETs are enhancement mode transistors, the pixel capacitance $C_P$ is charged so as to have a voltage lower than the positive voltage of the holding capacitance $C_H$ by the threshold voltage of the N-channel MOSFET, or discharged so as to have a voltage higher than the negative voltage of the holding capacitance $C_H$ by the threshold voltage of the P-channel MOSFET.

As a result, in each pixel, a data signal supplied via the switching element 1 can be thoroughly held by the holding capacitance $C_H$. Accordingly, when the voltage of the pixel capacitance $C_P$ is decreased due to a leak current, the bidirectional amplifier 2 can compensate this decrease, thereby maintaining a clear display for a long period of time.

Example 2

Figure 3:
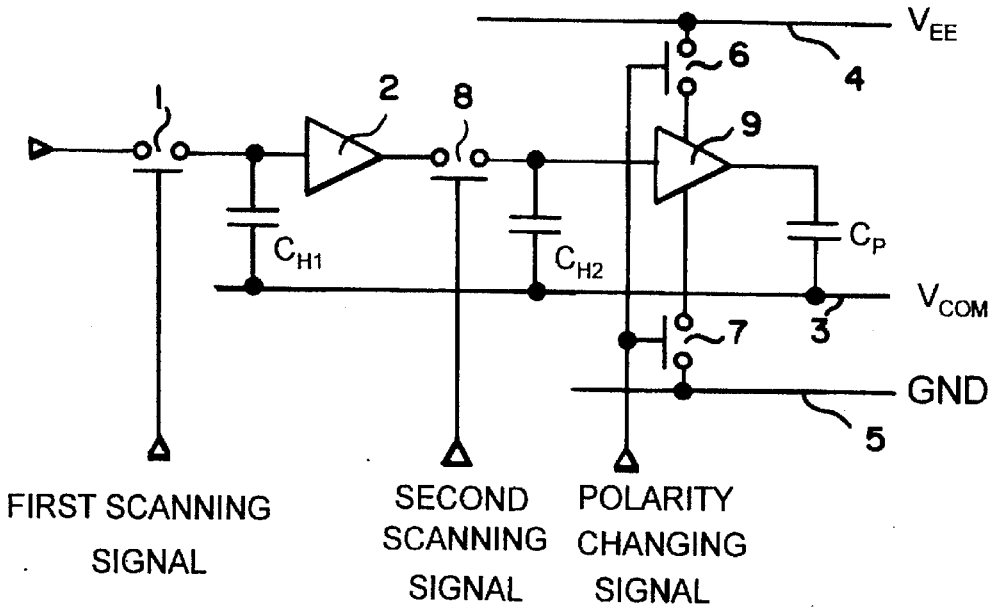
FIG. 3 is a circuit block diagram for the structure of a pixel according to Example 2 of this invention.
Figure 4:
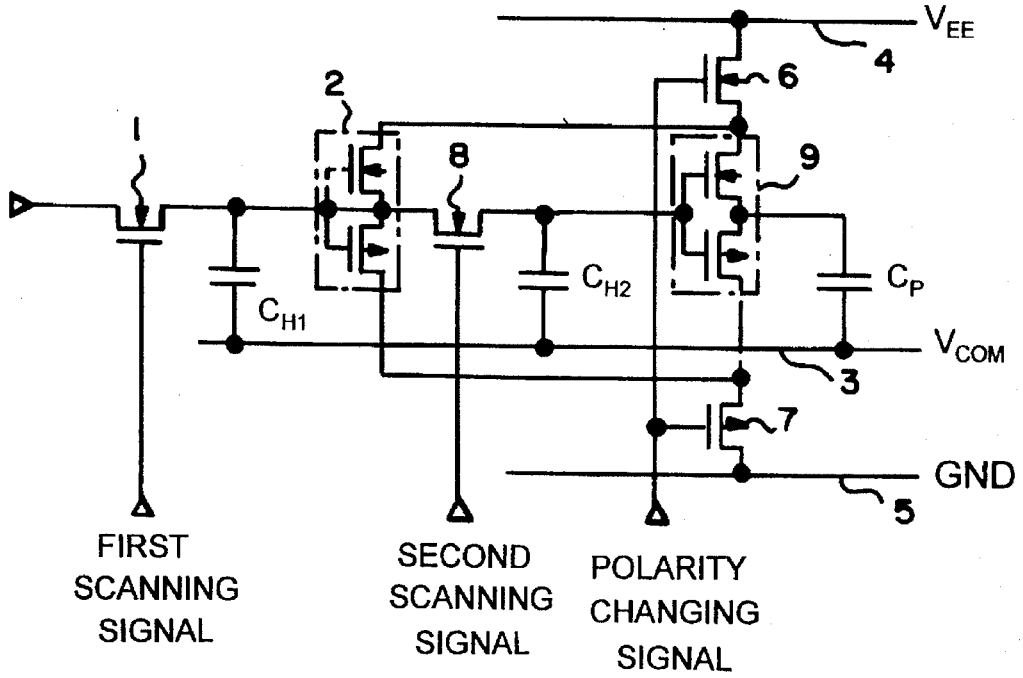
FIG. 4 is a specific circuit diagram of the pixel of FIG. 2.

FIG. 3 is a circuit block diagram for a pixel of this example, and FIG. 4 is a specific circuit diagram for the pixel of FIG. 3.

In this example, the sample and hold circuit of the pixel of Example 1 is replaced with that of a master-slave system.

In this example, as is shown in FIGS. 3 and 4, the sample and hold circuit of Example 1 is replaced with two pairs of sample and hold Circuits one of which includes the switching element I, a first holding capacitance $C_{H1}$ and the bidirectional amplifier 2, and the other of which includes a switching element 8, a second holding capacitance $C_{H2}$ and a bidirectional amplifier 9. A data signal is supplied to the first holding capacitance $C_{H1}$ via the switching element 1. In accordance with the voltage of the first holding capacitance $C_{H1}$, the bidirectional amplifier 2 charges or discharges the second holding capacitance $C_{H2}$ via the switching element 8. In accordance with the voltage of the second holding capacitance $C_{H2}$, the bidirectional amplifier 9 charges or discharges the pixel capacitance $C_P$. The switching element i is controlled to be turned on/off by a first scanning signal, and the switching element 8 is controlled to be turned on/off by a second scanning signal.

In the pixel of Example 1 shown in FIG. 1, it is impossible to rapidly change the electric charge of the pixel capacitance $C_P$, if the writing period, when the switching element I is on, is long. However, in this example, the data signal supplied to each pixel is held by the first holding capacitance $C_{H1}$ by activating a first scanning signal. When a second scanning signal is activated after the first scanning signal is deactivated, the bidirectional amplifier 2 charges or discharges the second holding capacitance $C_{H2}$ via the switching element 8. In response to this charging or discharging, the pixel capacitance $C_P$ is charged or discharged by the bidirectional amplifier 9. Therefore, the voltage of the pixel capacitance $C_P$ is maintained by the second holding capacitance $C_{H2}$ during the writing period when the first scanning signal is active and the switching element i is on. As a result, a display based on the previous data signal can be maintained during the writing period.

Accordingly, this example makes it possible to maintain a display based on the previous data signal during the writing period and to change the electric charge of the pixel capacitance $C_P$ in a short time by using a second scanning signal, even if the writing period for supplying a data signal to a pixel is long.

Example 3

Figure 5:
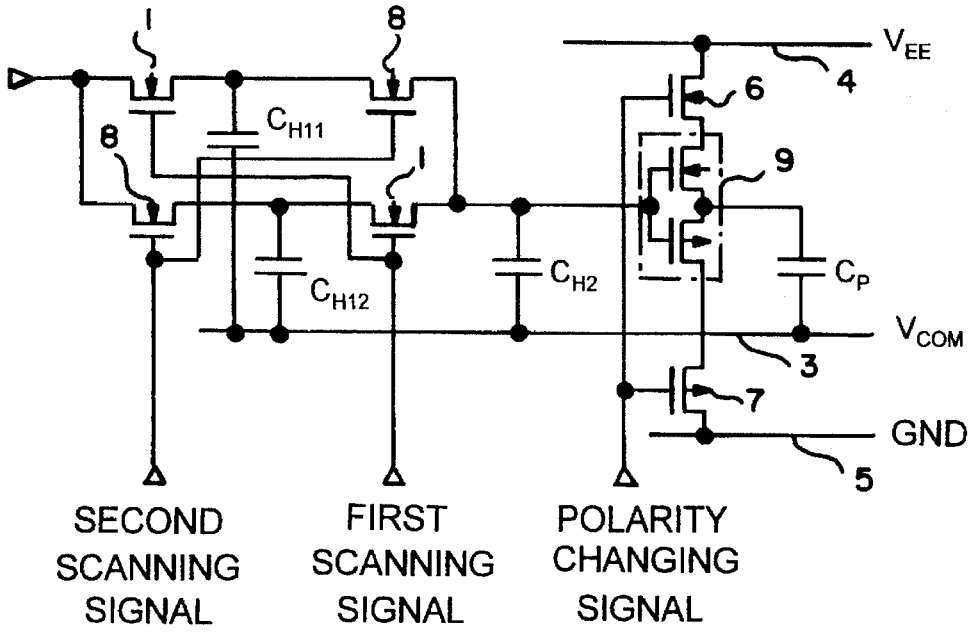
FIG. 5 is a specific circuit diagram of a pixel according to Example 3 of this invention.

FIG. 5 is a specific circuit diagram for a pixel of this example.

In this example, the first holding capacitance $C_{H1}$, which is used in Example 2 and shown in FIGS. 3 and 4, is divided into a first holding capacitances $C_{H11}$ and $C_{H12}$, and the bidirectional amplifier 2 of Example 2 is omitted. Therefore, in this example, during the first scanning signal is active, the two switching elements 1 are on. A data signal is then supplied to the first holding capacitance $C_{H11}$, and the electric charge held by the first holding capacitance $C_{H12}$ is distributed to the second holding capacitance $C_{H2}$. During the second scanning signal is active, the two switching elements 8 are on. A data signal is supplied to the first holding capacitance $C_{H12}$, and the electric charge held by the first holding capacitance $C_{H11}$ is distributed to the second holding capacitance $C_{H2}$.

In order to avoid the influence of voltage degradation caused by the distribution of the electric charge held in the first holding capacitances $C_{H11}$ and $C_{H12}$ to the second holding capacitance $C_{H2}$, it is necessary to make the capacitance of the second holding capacitance $C_{H2}$ sufficiently smaller than the capacitances of the first holding capacitances $C_{H11}$ and $C_{H12}$.

Example 4

Figure 6:
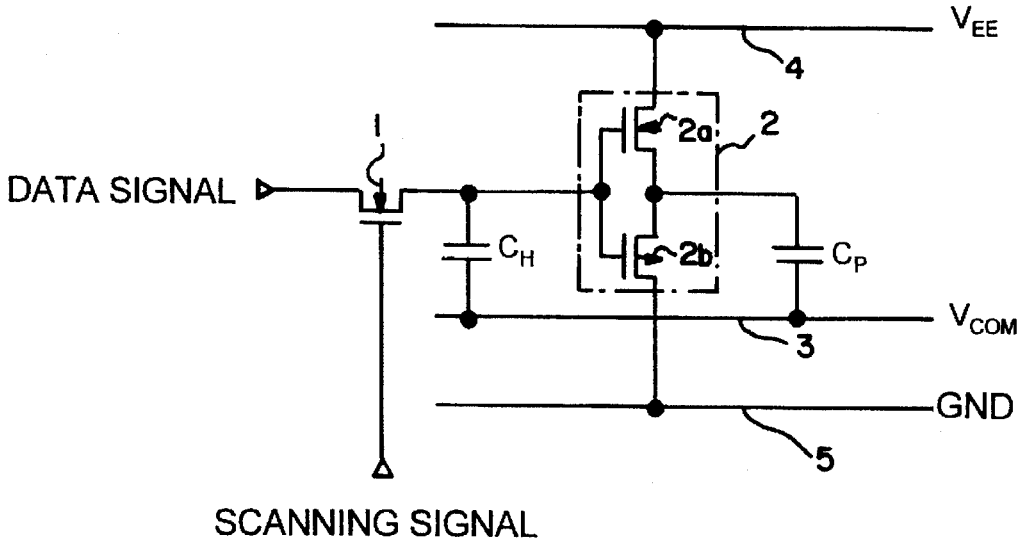
FIG. 6 is a specific circuit diagram of a pixel according to Example 4 of this invention.
Figure 7:
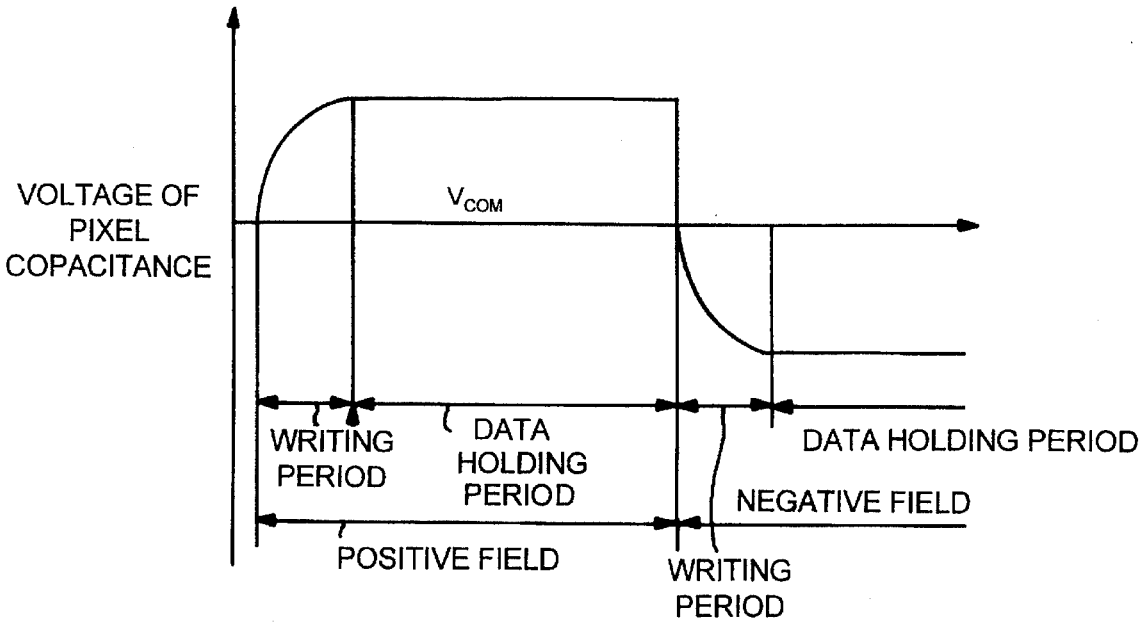
FIG. 7 is a time chart of a voltage of a pixel capacitance according to Example 4 of this invention.

FIG. 6 is a specific circuit diagram for a pixel of this example and FIG. 7 is a time chart showing the voltage of a pixel capacitance of this example.

In this example, the switching elements 6 and 7 of Example 1 are not used as is shown in FIG. 6.

In this example, as in the circuit of Example 1 shown in FIG. 2, to one electrode of the holding capacitance $C_H$ is input a data signal via the switching element 1, and this electrode is connected to the input terminal of the bidirectional amplifier 2. The other electrode of the holding capacitance $C_H$ is connected to the common line 3. One electrode of the pixel capacitance $C_P$ is connected to the output terminal of the bidirectional amplifier 2, and the other electrode is connected to the common line 3. In the circuit of FIG. 6, the bidirectional amplifier 2 is formed by a N-channel MOSFET 2*a* and a P-channel MOSFET 2*b*. The gate terminals of these MOSFETs 2*a* and 2*b* are connected to each other to provide the input terminal of the bidirectional amplifier 2, and the source terminals thereof are connected to each other to provide the output terminal of the bidirectional amplifier 2.

In the bidirectional amplifier 2, the drain terminal of the N-channel MOSFET 2*a* is directly connected to the high voltage source line 4, and the drain terminal of the P-channel MOSFET 2*b* is directly connected to the ground line 5. Also in such a circuit excluding the switching elements 6 and 7, the N-channel MOSFET 2*a* alone is activated in the positive field and a current is supplied from the high voltage source line 4 to charge the pixel capacitance $C_P$. The P-channel MOSFET 2*b* alone is activated in the negative field, and a current is drawn to the ground line 5 to discharge the pixel capacitance $C_P$. Moreover, when the voltage of the holding capacitance $C_H$ becomes higher than the voltage of the pixel capacitance $C_P$ by the threshold voltage of the N-channel MOSFET 2*a*, the N-channel MOSFET 2*a* alone is activated and a current can be supplied from the high voltage source line 4 to the pixel capacitance $C_P$. When the voltage of the holding capacitance $C_H$ becomes lower than the voltage of the pixel capacitance $C_P$ by the threshold voltage of the P-channel MOSFET 2*b*, the P-channel MOSFET 2*b* alone is activated and a current is drawn from the pixel capacitance $C_P$ to the ground line 5. Therefore, since the voltage of the pixel capacitance $C_P$ can follow the holding capacitance $C_H$ even when the voltage of the holding capacitance $C_H$ varies in the same polarity, the structure of this example can be used in a display apparatus that is not driven by the alternating driving.

In the alternating driving of the pixel with the above-mentioned structure, the beginnings of the positive and the negative fields correspond to the writing period, and the periods thereafter are the data holding periods. For example, during the writing period in the positive field, a scanning signal is activated to turn the switching element 1 on, thereby supplying a positive data signal to the holding capacitance $C_H$. Moreover, when the voltage of the holding capacitance $C_H$ is raised by the supply of the data signal, the N-channel MOSFET 2*a* of the bidirectional amplifier 2 is activated to supply a current from the high voltage source line 4 to the pixel capacitance $C_P$. As a result, the voltage of the pixel capacitance $C_P$ is also raised as is shown in FIG. 7. At this point, the voltage of the pixel capacitance $C_P$ is raised to a voltage which is lower than the positive voltage of the holding capacitance $C_H$ by the threshold voltage of the N-channel MOSFET 2*a*, resulting in charging the pixel capacitance $C_P$ so as to have a voltage approximately in accordance with the data signal. When the period is changed to the data holding period in the positive field, the switching element i is turned off and the holding capacitance $C_H$ holds the voltage at the end of the writing period. Therefore, whenever the voltage of the pixel capacitance $C_P$ is decreased due to a leak current, the N-channel MOSFET 2*a* compensates the decrease, resulting in maintaining the same voltage level as shown in FIG. 7.

Also during the writing period in the negative field, a scanning signal is activated to turn the switching element 1 on. Since the holding capacitance $C_H$ is supplied with a negative data signal, the voltage of the holding capacitance $C_H$ is decreased to have a potential lower than the potential $V_{COM}$ of the common line 3. Then, the P-channel MOSFET 2*b* of the bidirectional amplifier 2 is activated, and a current is drawn to the ground line 5 from the pixel capacitance $C_P$. As a result, the voltage of the pixel capacitance $C_P$ is also decreased as shown in FIG. 7. At this point, the voltage of the pixel capacitance $C_P$ is decreased to a voltage which is higher than the negative voltage of the holding capacitance $C_H$ by the threshold voltage of the P-channel MOSFET 2*b*. As a result, the pixel capacitance $C_P$ is discharged so as to have a voltage approximately in accordance with the data signal. When the period is changed to the data holding period in the negative field, the switching element 1 is turned off and the holding capacitance $C_H$ holds the voltage at the end of the writing period. Therefore, whenever the voltage of the pixel capacitance $C_P$ is increased due to a leak current, the P-channel MOSFET 2*b* compensates this increase, resulting in maintaining the same voltage level as shown in FIG. 7.

As a result, also in the pixel of this example, a data signal supplied through the switching element 1 is thoroughly held by the holding capacitance $C_H$. When the voltage of the pixel capacitance $C_P$ is decreased due to a leak current, the bidirectional amplifier 2 can compensate the decrease. As a result, a clear display can be maintained for a long period of time.

Example 5

Figure 8:
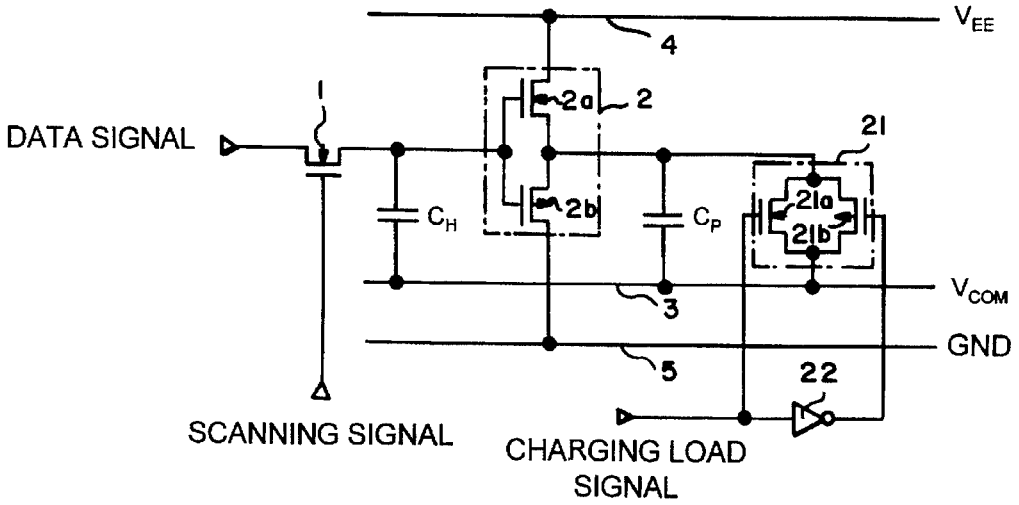
FIG. 8 is a specific circuit diagram of a pixel according to Example 5 of this invention.
Figure 9:
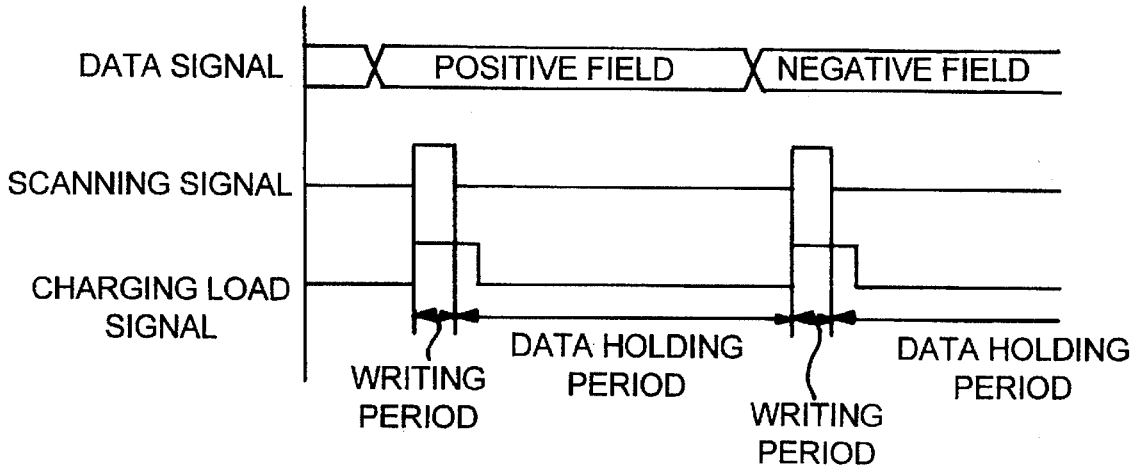
FIG. 9 is a time chart of a timing of a charging load control signal according to Example 5 of this invention.

FIG. 8 is a specific circuit diagram for a pixel of this example and FIG. 9 is a time chart for showing the timing of a electric charging load control signal.

In this example, a charging load circuit is added to the circuit of Example 4 as shown in FIG. 8. The switching element 1, the bidirectional amplifier 2, the holding capacitance $C_H$ and the pixel capacitance $C_P$ are the same as in Example 4 shown in FIG. 6. The difference is a charging load circuit 21 provided in parallel with the pixel capacitance $C_P$ in this example.

The charging load circuit 21 is formed by a N-channel MOSFET 21*a* and a P-channel MOSFET 21*b*. These MOSFETs 21*a* and 21*b* have a sufficient channel length, thereby providing a large ON resistance. The source terminals of the MOSFETs 21*a* and 21*b* are connected to each other to be connected to one electrode of the pixel capacitance $C_P$, which is connected to the output terminal of the bidirectional amplifier 2. The drain terminals of the MOSFETs 21*a* and 21*b* are connected to the common line 3. A charging load control signal is input to the gate terminal of the N-channel MOSFET 21*a*, and the charging load control signal is inverted by an inverter 22 to input to the gate terminal of the P-channel MOSFET 21*b*. Therefore, when the charging load control signal is at a high level, a current flows from the output terminal of the bidirectional amplifier 2 through the P-channel MOSFET 21*b* having a large ON resistance to the common line 3 in the positive field. In the negative field, a current flows from the common line 3 through the N-channel MOSFET 21*a* with a large ON resistance to the output terminal of the bidirectional amplifier 2. Moreover, when the charging load control signal is at a low level, both the MOSFETs 21*a* and 21*b* are turned off, thereby cutting off the charging load circuit 21. The charging load control signal becomes high for a certain period of time including the writing periods in the positive and negative fields, and is output from a control circuit (not shown).

The operation of the pixel having the abovementioned structure in the alternating driving is almost the same as in Example 4. However, in Example 4, the bidirectional amplifier 2 works together with the pixel capacitance $C_P$ alone as a load. Therefore, for example, at the end of the writing period in the positive field, when the voltage of the pixel capacitance $C_P$ is raised nearly to a voltage which is lower than the voltage of the holding capacitance $C_H$ by the threshold voltage of the N-channel MOSFET 2*a* (hereinafter referred to the "positive full charge voltage"), the N-channel MOSFET 2*a* is turned off. Therefore, the output impedance of the bidirectional amplifier 2 becomes high, resulting in an unstable voltage of the pixel capacitance $C_P$. When the voltage of the pixel capacitance $C_P$ becomes higher than the positive full charge voltage due to a switching noise and the like, the N-channel MOSFET 2*a* is completely turned off. Moreover, the P-channel MOSFET 2*b* remains to be off unless the voltage of the pixel capacitance $C_P$ is further raised to a voltage which is higher than the voltage of the holding capacitance $C_H$ by the threshold voltage of the P-channel MOSFET 2*b*. In such a case, the voltage of the pixel capacitance $C_P$ is gradually decreased down to the positive full charge voltage due to a leak current during the data holding period, resulting in a little variation in the displayed image or a flicker. Moreover, in the negative field, if the voltage of the pixel capacitance $C_P$ is raised to a voltage which is higher than the voltage of the holding capacitance $C_H$ by the threshold voltage of the P-channel MOSFET 2*b* (hereinafter referred to as the "negative full charge voltage"), the voltage of the pixel capacitance $C_P$ is gradually increased due to a leak current during the data holding period, resulting in causing a similar variation in the displayed image or the flicker.

In this example, however, as is shown in FIG. 9, a scanning signal is activated during the writing periods at the beginning of the positive and the negative fields, and at the same time, the charging load control signal becomes high. Then, the charging load control signal becomes low, a short period after the writing period is over and the scanning signal is deactivated. Then, for example, in the positive field, since the charging load control signal is also at a high level during the writing period, a current supplied by the N-channel MOSFET 2*a* of the bidirectional amplifier 2 not only charges the pixel capacitance $C_P$ but also leaks through the P-channel MOSFET 21*b* in the charging load circuit 21 to the common line 3. Therefore, in this case, since the output impedance of the bidirectional amplifier 2 does not exceed the ON resistance of the P-channel MOSFET 21*b*, the voltage of the pixel capacitance $C_P$ stably rises nearly to the positive full charge voltage. When the writing period is over and the data holding period starts, the charging load control signal becomes low, thereby cutting off the charging load circuit 21 from the pixel capacitance $C_P$. At this point, since the voltage of the pixel capacitance $C_P$ is stable at a value slightly lower than the positive full charge voltage, the bidirectional amplifier 2 can maintain the voltage of the pixel capacitance $C_P$ also during the following data holding period. Also in the negative field, since the charging load control signal is at a high level during the writing period, the P-channel MOSFET 2*b* of the bidirectional amplifier 2 not only discharges the pixel capacitance $C_P$ but also draws a current from the common line 3 through The N-channel MOSFET 21*a* in the charging load circuit 21. Therefore, also in this case, since the output impedance of the bidirectional amplifier 2 does not exceed the ON resistance of the N-channel MOSFET 21*a*, the voltage of the pixel capacitance $C_P$ stably decreases nearly to the negative full discharge voltage. When the writing period is over and the data holding period starts, the charging load control signal becomes low, thereby cutting off the charging load circuit 21 from the pixel capacitance $C_P$. At this point, the voltage of the pixel capacitance $C_P$ is stable at a value slightly higher than the negative full charge voltage. Therefore, the bidirectional amplifier 9 can maintain the voltage of the pixel capacitance $C_P$ also during the following data holding period.

The charging load circuit 21 can be formed by an ordinary resistance element and the like only to stabilize the voltage of the pixel capacitance $C_P$. In such a case, however, the increase in the used power can become too large to ignore because a current is always flowing through the charging load circuit 21. Therefore, when the charging load circuit 21 is formed by the MOSFETs 21*a* and 21*b* having a large ON resistance and controlled by the charging load control signal as in this example, the MOSFETs work as resistances during the writing period, and the charging load circuit 21 can be cut off from the pixel capacitance $C_P$ during the data holding period. As a result, the power loss can be prevented from increasing.

As a result, in this example, since a current flows through the charging load circuit 21 during the charging and discharging of the pixel capacitance $C_P$, the MOSFETs 2*a* and 2*b* of the bidirectional amplifier 2 are not turned completely off. Thus, the voltage of the pixel capacitance $C_P$ can be stabilized, thereby maintaining a further clear display for a long period of time. Moreover, when the voltage of the pixel capacitance $C_P$ is stabilized after the writing period, the increase in the power loss can be avoided by cutting off the charging load circuit 21 by a charging load control signal.

In this example, the charging load circuit 21 is connected to the pixel capacitance $C_P$ of Example 4, but a similar charging load circuit can be connected to any of the pixel capacitances $C_P$ in other examples.

Example 6

Figure 10:
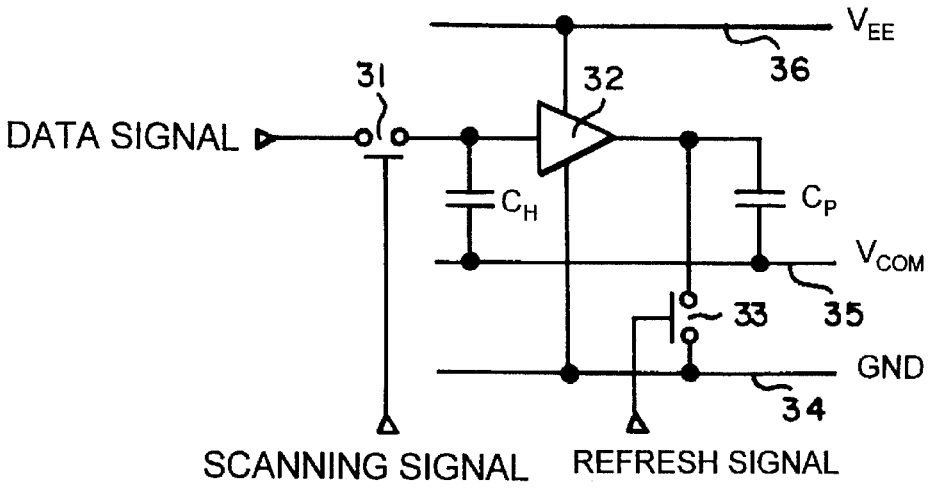
FIG. 10 is a circuit block diagram for the structure of a pixel according to Example 6 of this invention.

FIG. 10 is a circuit block diagram for a pixel of this example.

In this example, a liquid crystal display apparatus of an active matrix driving system used for a liquid crystal television will be described.

Each pixel of the liquid crystal display apparatus of this example has, as is shown in FIG. 10, a sample and hold circuit. Each pixel has the holding capacitance $C_H$ formed on a substrate as a capacitance element and the pixel capacitance $C_P$ including a liquid crystal provided as a display element. To one electrode of the holding capacitance $C_H$ is input a data signal via a switching element 31. This electrode of the holding capacitance $C_H$ is connected to the input terminal of a buffer amplifier 32. The switching element 31 is a circuit element which is controlled to be turned on/off by a scanning signal. The output terminal of the buffer amplifier 32 is connected to one electrode of the pixel capacitance $C_P$. This electrode of the pixel capacitance $C_P$ is connected to a ground line 34 via a switching element 33. The switching element 33 is a circuit element which is controlled to be turned on/off by a refresh signal. The other electrodes of the holding capacitance $C_H$ and the pixel capacitance $C_P$ are connected to a common line 35.

The buffer amplifier 32 is an amplifier which is operated by using a high voltage source line 36 and the ground line 34 as power supplies and has a large input impedance and a small output impedance. When the potentials of the high voltage source line 36 and the ground line 34 are taken as $V_{EE}$ and GND, respectively, the potential $V_{COM}$ of the common line 35 is settled at an approximately medium value between the $V_{EE}$ and the GND. Therefore, the buffer amplifier 32 supplies a current from the high voltage source line 36 so as to make the pixel capacitance $C_P$ have a voltage in accordance with the voltage of the holding capacitance $C_H$, thereby charging the pixel capacitance $C_P$. When the voltage of the pixel capacitance $C_P$ is already higher than the voltage in accordance with the voltage of the holding capacitance $C_H$, the buffer amplifier 32 does not work.

In the pixel having the above-mentioned structure, the switching element 31 is turned on when a scanning signal is activated, thereby supplying a data signal of a pixel data to the holding capacitance $C_H$ (for sampling) and holding the data signal in the holding capacitance $C_H$ by turning the switching element 31 off (for holding). Therefore, the switching element 31, the holding capacitance $C_H$ and the buffer amplifier 32 form the sample and hold circuit. Since the holding capacitance $C_H$ is formed as a capacitance element, a leak current is scarcely caused. Moreover, since the refresh signal is also activated once at this point, the voltage of the pixel capacitance $C_P$ is decreased down to the GND level by the ground line 34. When the refresh signal is deactivated again, the buffer amplifier 32 supplies a current from the high voltage source line 36 so as to make the pixel capacitance $C_P$ have a voltage in accordance with the voltage of the holding capacitance $C_H$, thereby charging the pixel capacitance $C_P$. At this point, since the data signal is always at the voltage level between the $V_{EE}$ level and the GND level, the voltage of the pixel capacitance $C_P$ which has been reduced to the GND level is charged so as to have a voltage in accordance with the voltage of the data signal.

As a result, the data signal supplied through the switching element 31 is held by the holding capacitance $C_H$ in each pixel. Therefore, whenever the voltage of the pixel capacitance $C_P$ thus charged is decreased due to a leak current, the buffer amplifier 32 can compensate the decrease, thereby maintaining a clear display for a long period of time. Moreover, when a new data signal is supplied, the voltage of the pixel capacitance $C_P$ is discharged through the switching element 33 to the GND level. Therefore, the buffer amplifier 32 can charge the pixel capacitance $C_P$ to a voltage in accordance with the new data signal by the unidirectional operation for supplying a current from the high voltage source line 36. Therefore, the alternating driving can be attained in which the polarity of the data signal is alternately changed with regard to the potential $V_{COM}$ of the common line 35 as 0 potential.

Figure 11:
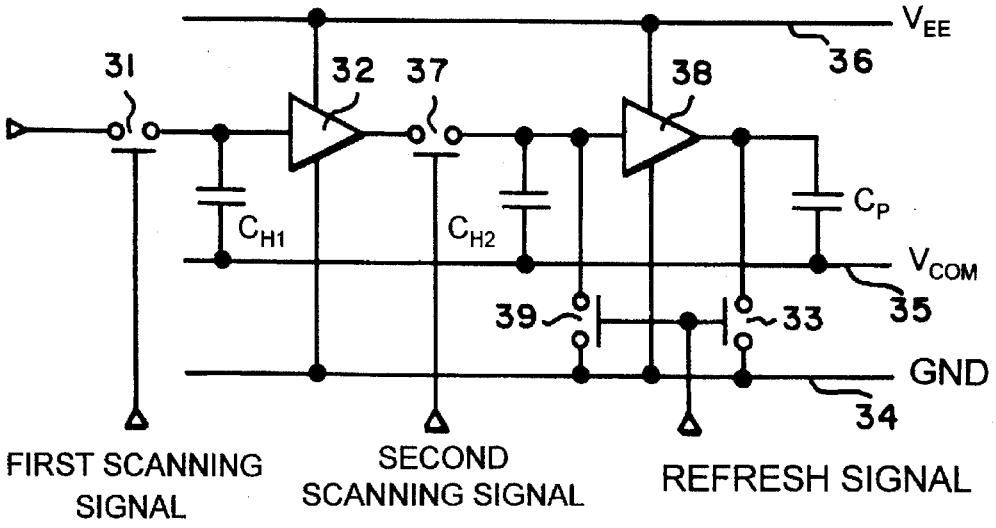
FIG. 11 is a circuit block diagram for a modified structure of the pixel of FIG. 10.

FIG. 11 is a circuit block diagram when the sample and hold circuit of the pixel shown in FIG. 10 applies the master-slave system.

In this circuit, the sample and hold circuit of FIG. 10 is replaced with two pairs of sample and hold circuits, one of which includes the switching element 31, a first holding capacitance $C_{H1}$ and the buffer amplifier 32 and the other of which includes a switching element 37, a second holding capacitance $C_{H2}$ and a buffer amplifier 38. A data signal is supplied to the first holding capacitance $C_{H1}$ via the switching element 31. The output of the buffer amplifier 32 in accordance with the voltage of the first holding capacitance $C_{H1}$ is supplied to the second holding capacitance $C_{H2}$ via the switching element 37. The output of the buffer amplifier 38 in accordance with the voltage of the second holding capacitance $C_{H2}$ is supplied to the pixel capacitance $C_P$. The switching element 31 is controlled to be turned on/off by a first scanning signal, and the switching element 37 is controlled to be turned on/off by a second scanning signal. One electrode of the second holding capacitance $C_{H2}$ is, as in the pixel capacitance $C_P$, connected to the ground line 34 via a switching element 39, which is controlled to be turned on/off by a refresh signal.

In the pixel having the structure as shown in FIG. 10, if the writing period when the switching element 31 is on is long, the electric charge of the pixel capacitance $C_P$ can not be rapidly changed. In the pixel having the structure as shown in FIG. 11, however, the data signal having supplied to each pixel is first held by the first holding capacitance $C_{H1}$ by activating the first scanning signal. Then, after the first scanning signal is deactivated and the second scanning signal is activated, the buffer amplifier 32 charges the second holding capacitance $C_{H2}$ via the switching element 37, in response to which the pixel capacitance $C_P$ is charged by the buffer amplifier 38. Therefore, during the writing period when the first scanning signal is activated and the switching element 31 is on, the voltage of the pixel capacitance $C_P$ is maintained by the second holding capacitance $C_{H2}$. As a result, a display based on the previous data signal can be maintained during the writing period.

As a result, according to the structure as shown in FIG. 11, even when the writing period for supplying a data signal to a pixel is long, a display based on the previous data signal can be maintained during this writing period, and the electric charge of the pixel capacitance $C_P$ can be rapidly changed by a second scanning signal.

When a refresh signal is activated, the switching elements 33 and 39 are turned on, and both the pixel capacitance $C_P$ and the second holding capacitance $C_{H2}$ are discharged. Thus, charging based on a new data signal can be attained. Moreover, in the structure as shown in FIG. 10, when the switching element 33 is on in refreshing the pixel capacitance $C_P$, a current flows from the high voltage source line 36 to the ground line 34 via the buffer amplifier 32. However, since the second holding capacitance $C_{H2}$ is discharged at the same time in the circuit of FIG. 11, such an undesired current can be eliminated, thereby decreasing the power loss in the pixel.

Figure 12:
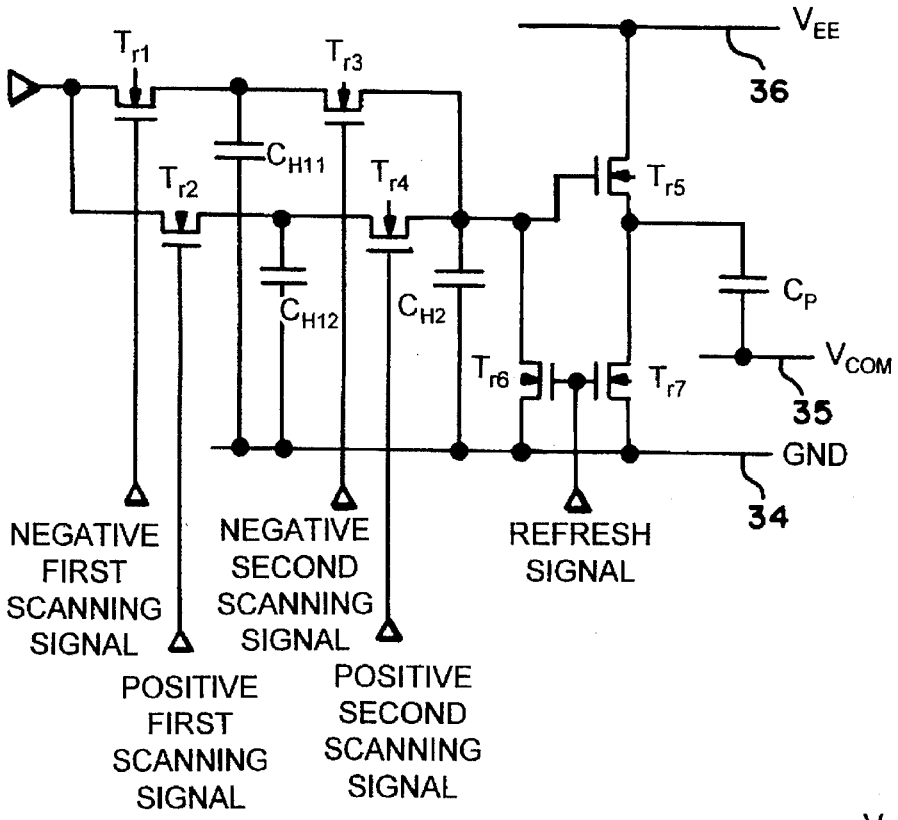
FIG. 12 is a circuit block diagram for a modified structure of the pixel of FIG. 11.

FIG. 12 is a circuit block diagram showing a specific structure for the pixel of FIG. 11.

In this circuit, the sample and hold circuit of FIG. 11 is further divided into two. A positive data signal is supplied to one of them, and a negative data signal is supplied to the other.

A data signal is supplied to one of the electrodes of the first holding capacitances $C_{H11}$ and $C_{H12}$ via transistors $Tr_1$ and $Tr_2$, respectively. These electrodes are both connected to one electrode of the second holding capacitance $C_{H2}$ via transistors $Tr_3$ and $Tr_4$, respectively. When the first holding capacitances $C_{H11}$ and $C_{H12}$ are directly connected to the second holding capacitance $C_{H2}$ via the transistors $Tr_3$ and $Tr_4$ alone in this manner, the electric charge in the first holding capacitances $C_{H11}$ and $C_{H12}$ is distributed to the second holding capacitance $C_{H2}$. Therefore, in order to avoid the influence by the voltage degradation, it is necessary not to turn on the transistors $Tr_1$ to $Tr_4$ at the same time and to make the capacity of the second holding capacitance $C_{H2}$ sufficiently smaller than those of the first holding capacitances $C_{H11}$ and $C_{H12}$.

One electrode of the second holding capacitance $C_{H2}$ is connected to the gate terminal of the transistor $Tr_5$, whose source terminal is connected to one electrode of the pixel capacitance $C_P$. The drain terminal of the transistor $Tr_5$ is connected to the high voltage source line 36.

These electrodes of the second holding capacitance $C_{H2}$ and the pixel capacitance $C_P$ are connected to the ground line 34 via the transistors $Tr_6$ and $Tr_7$, respectively. Moreover, in the circuit of FIG. 12, the other electrodes of the first holding capacitances $C_{H11}$ and $C_{H12}$ and the second holding capacitance $C_{H2}$ are connected to the ground source line 34, thereby setting the base voltage of these capacitances at the GND level. The other electrode of the pixel capacitance $C_P$ is connected to the common line 35. Thus, a buffer amplifier is formed as a voltage follower circuit.

In the pixel having the above-mentioned structure, the transistor $Tr_1$ is turned on when a negative first scanning signal is activated, thereby supplying a data signal to the first holding capacitance $C_{H11}$. When a negative second scanning signal is then activated, the transistor $Tr_3$ is turned on, thereby distributing the electric charge to the second holding capacitance $C_{H2}$. When the positive first scanning signal is activated, the transistor $Tr_2$ is turned on, thereby supplying a data signal to the first holding capacitance $C_{H12}$. When a positive second scanning signal is then activated, the transistor $Tr_4$ is turned on, thereby distributing the electric charge to the second holding capacitance $C_{H2}$. A refresh signal has been previously activated, thereby turning the transistors $Tr_6$ and $Tr_7$ on to discharge the second holding capacitance $C_{H2}$ and the pixel capacitance $C_P$. Then, the transistor $Tr_5$ supplies a current from the high voltage source line 36 to the pixel capacitance $C_P$ in accordance with the voltage of the second holding capacitance $C_{H2}$ to which the electric charge has been distributed, thereby charging the pixel capacitance $C_P$. The pixel capacitance $C_P$ is charged so as to have a voltage which is lower than the voltage of the second holding capacitance $C_{H2}$ by the threshold voltage of the transistor $Tr_5$. The .voltage of the pixel capacitance $C_P$ can be maintained by compensating the electric charge which will be decreased due to a leak current thereafter.

Figure 34:
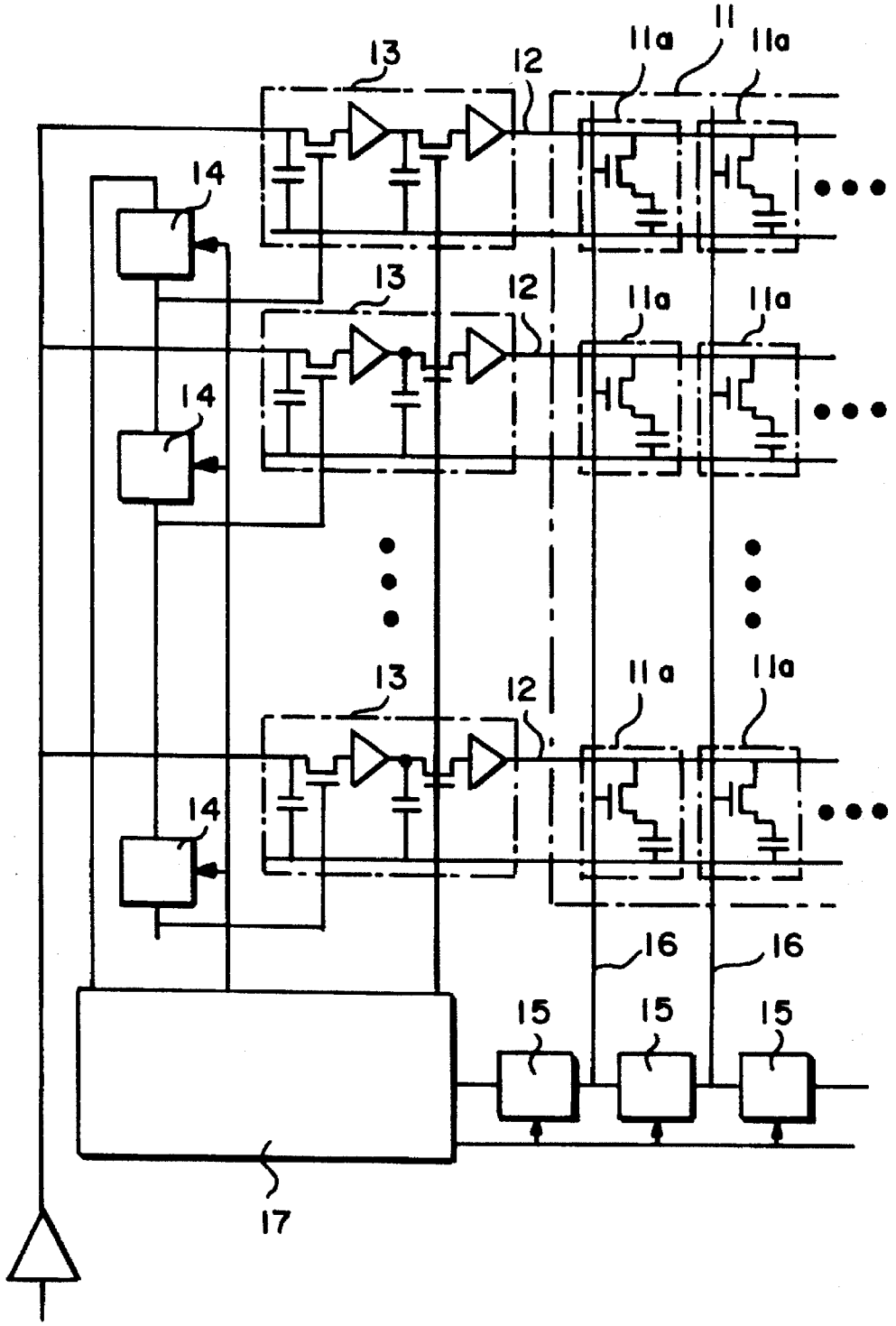
FIG. 34 is a circuit block diagram for a conventional liquid crystal display apparatus.

In a conventional liquid crystal display apparatus of an active matrix driving system, as shown in FIG. 34, sample and hold circuits 13 are provided on the side where data signal lines 12 are disposed for supplying data signals to a liquid crystal panel 11 including a plurality of pixels. Data signals are serially input to shift resisters 14, and supplied to the respective sample and hold circuits 13 in sequence to be held by the respective sample and hold circuits 13. Then, one of scanning lines 16 is activated by a shift resister 15, and the data signal is supplied to all the pixels 11*a* on the scanning line 16 simultaneously. However, when a data signal is supplied to the pixel via the transistor $Tr_8$, which is controlled to be turned on/off by a selecting signal, as in the circuit of this example shown in FIG. 13, it is possible to construct a liquid crystal display apparatus as schematically shown in FIG. 14.

Figure 14:
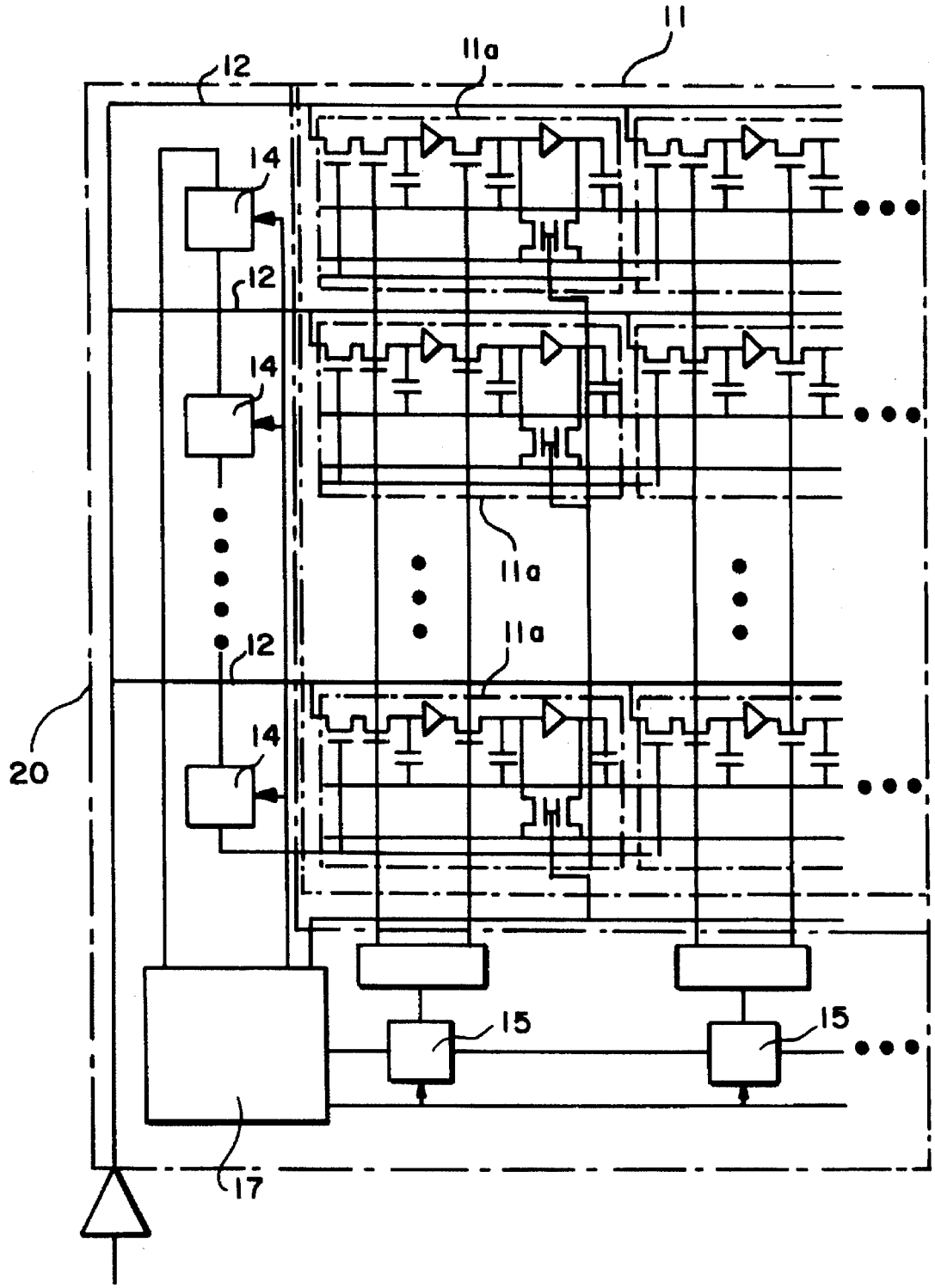
FIG. 14 is a circuit block diagram for a liquid crystal display apparatus according to Example 6 of this invention.

In the liquid crystal display apparatus of FIG. 14, a matrix of the pixels 11*a* is disposed in the liquid crystal panel 11, and each of the pixels 11*a* is provided with a switching element. A driving circuit 20 is disposed in the peripheral portion of the liquid crystal panel 11, and the driving circuit 20 is connected to the liquid crystal panel 11 via the data signal lines 12, scanning signal lines and the like. Therefore, when a sample and hold circuit is provided to each pixel 11*a* as in this example, The output of the shift resister 14 can be used as a selecting signal, and a data signal can be directly sent to each pixel 11*a* through the data signal line 12.

Figure 15:
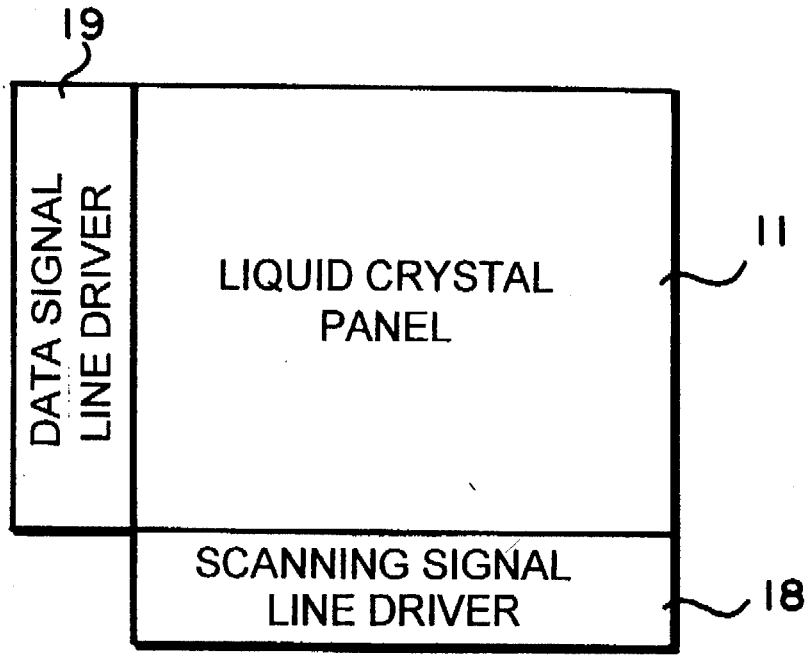
FIG. 15 is a schematic block diagram of a liquid crystal display apparatus of this invention.

FIG. 15 is a schematic view of the structure of a liquid crystal display apparatus. The liquid crystal panel 11 occupies a display portion. According to this example, a scanning signal line driver 18 and a data signal line driver 19, which are not included in the display portion, can be formed by the shift resisters 14 and 15 and a timing generating circuit 17 (see FIG. 14) alone, resulting in a compact liquid crystal display apparatus. The circuit structure of each pixel 11*a* is not limited to the structure described in this example but includes the circuit structures according to other examples.

Figure 13:
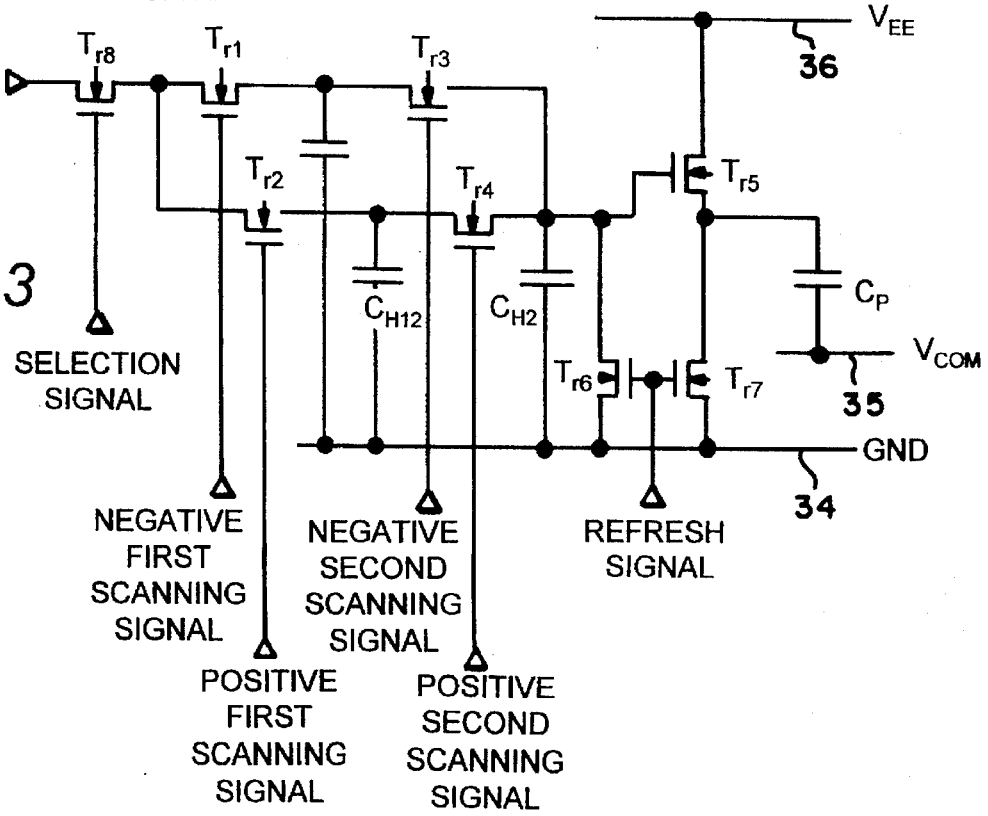
FIG. 13 is a circuit block diagram in which a selecting circuit is added to the pixel of FIG. 12.
Figure 16:
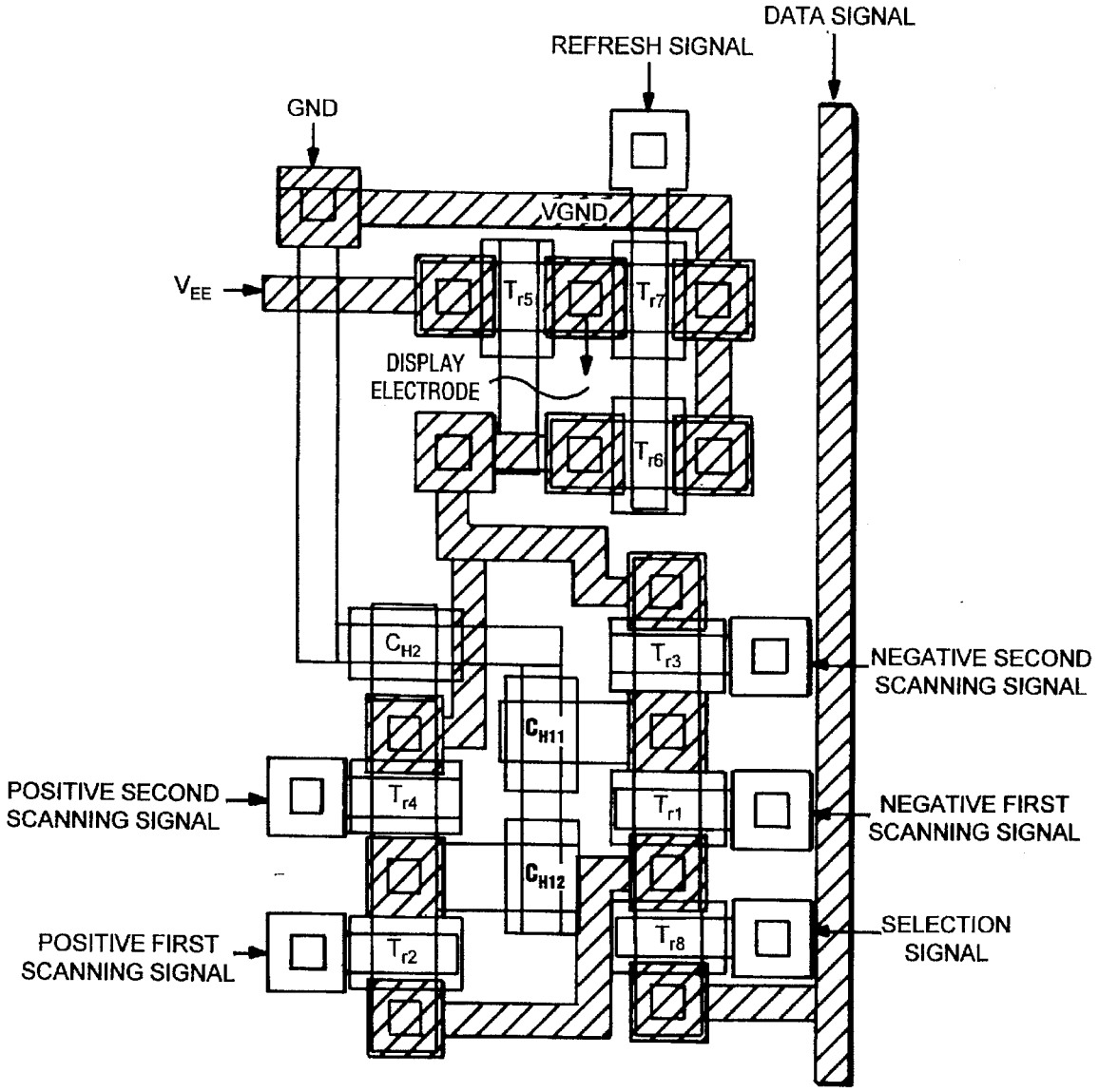
FIG. 16 shows a specific circuit layout of the circuit block diagram of FIG. 14.

Moreover, the transistors $Tr_1$ through $Tr_8$ in the pixel shown in FIG. 13 can be formed on a silicon semiconductor substrate beneath the liquid crystal panel 11 as is shown in a circuit layout of FIG. 16. When all the transistors $Tr_1$ through $Tr_8$ are formed from a N-channel MOSFET alone, there is no need to form a well for a P-channel MOSFET on the silicon semiconductor substrate, resulting in a small circuit pattern area.

Figure 17:
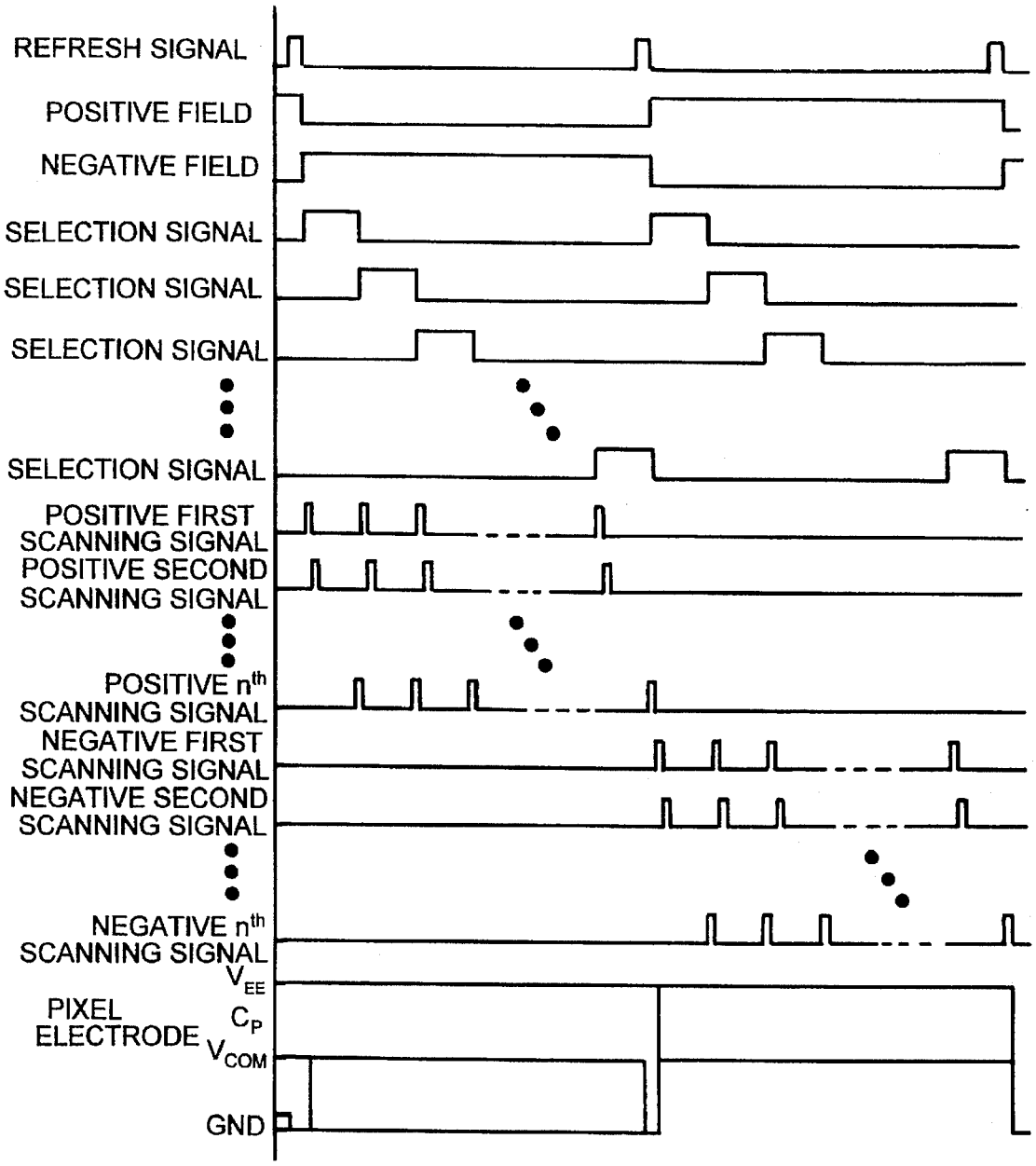
FIG. 17 is a time chart of the operation of the liquid crystal display apparatus of Example 6 of this invention.

FIG. 17 shows a timing chart of each signal in driving the liquid crystal display apparatus of FIG. 13. The refresh signal is activated in every positive or negative field, thereby simultaneously discharging the pixel capacitances $C_P$ in all the pixels. In the negative field, a negative data signal lower than the $V_{COM}$ is supplied, and a negative first scanning signal and a negative second scanning signal of FIG. 13 are activated in sequence in every pixel. In the positive field, a positive data signal higher than the $V_{COM}$ is supplied, and a positive first scanning signal and a positive second scanning signal are activated in sequence in every pixel.

In the liquid crystal display apparatus of FIG. 14, when an address selecting circuit used in an ordinary memory circuit is used in the liquid crystal panel 11, it is possible to randomly access each pixel 11*a*.

Figure 18:
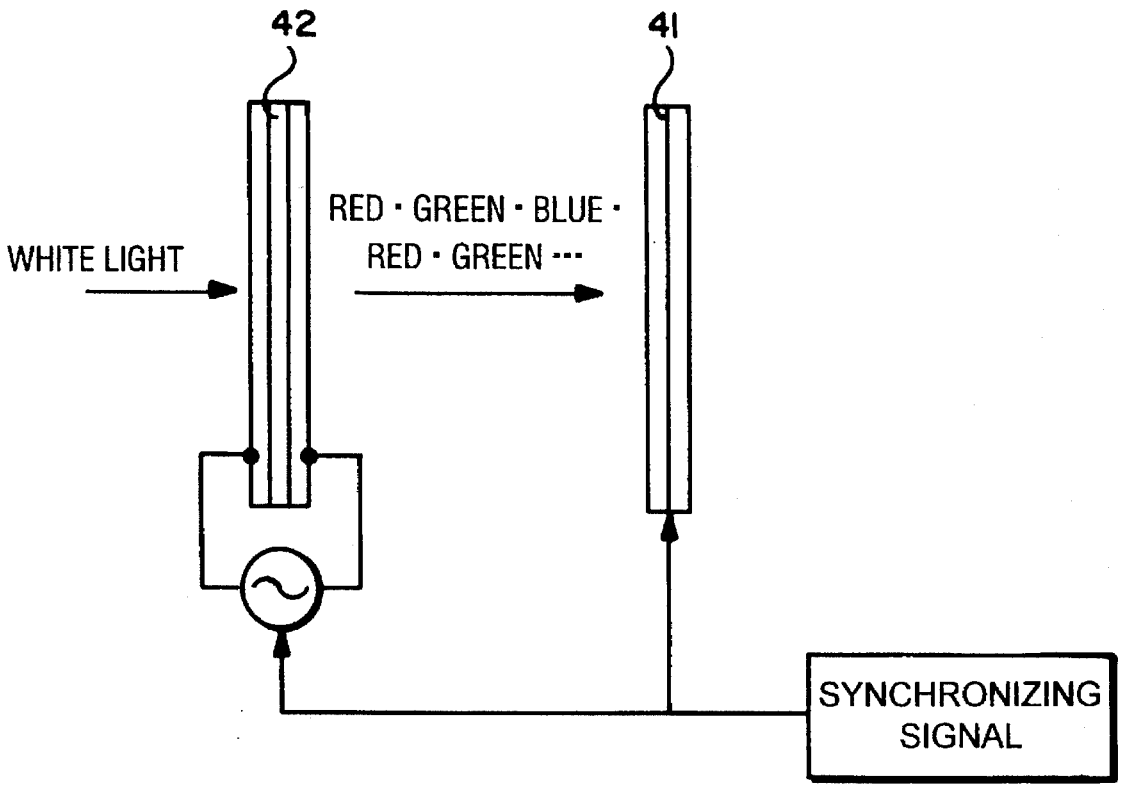
FIG. 18 is a structural diagram showing an example in which the liquid crystal display apparatus of Example 6 is used together with a fast color variable filter.

Moreover, it is possible to use a liquid crystal display apparatus 41 of this example together with a fast color variable filter 42 as is shown in FIG. 18. When a timing is controlled to refresh each pixel so as to display an image based on a new data signal every time light having a wavelength of each color of the three primary colors passes through the fast color variable filter 42, one and the same pixel can display the images with the respective colors. Therefore, when the liquid crystal display apparatus has, for example, the same number of the pixels as in a conventional display apparatus, a resolution three time as high as that of the conventional display apparatus can be attained.

As is apparent from the above description, the display apparatus of this example can provide a practical circuit in which a leak current from the pixel capacitance can be compensated by using the holding capacitance and the buffer amplifier to maintain a clear display for a long period of time.

Example 7

Figure 19:
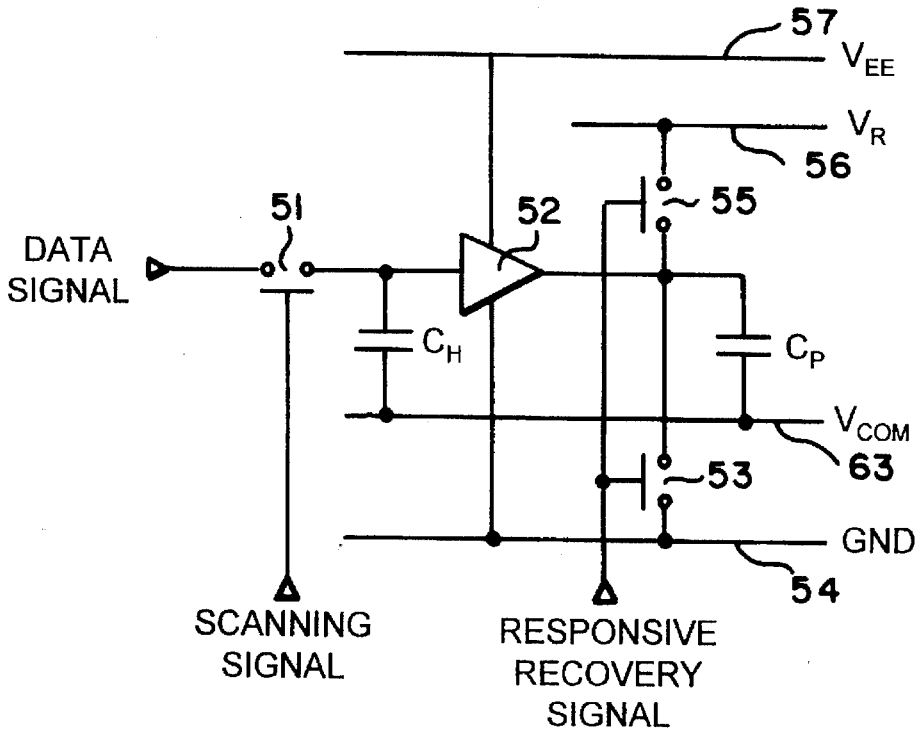
FIG. 19 is a circuit block diagram for the structure of a pixel according to Example 7 of this invention.
Figure 20:
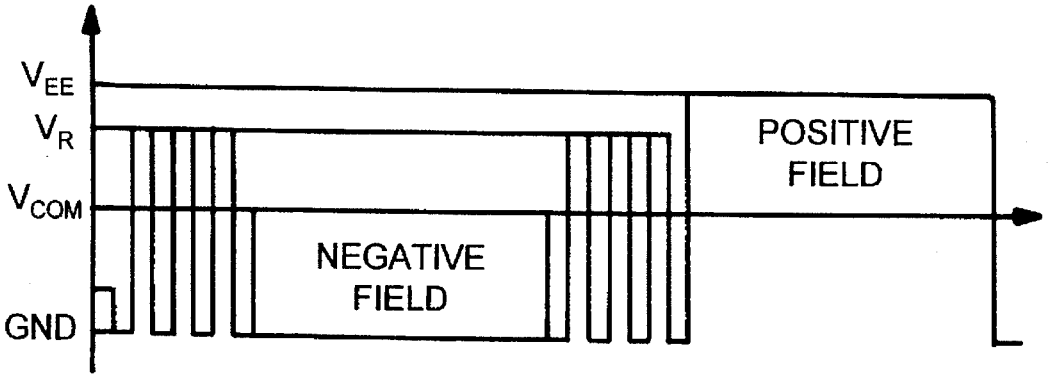
FIG. 20 is a time chart of a voltage applied to a pixel capacitance according to Example 7 of this invention.

FIG. 19 is a circuit block diagram for a pixel of this example, and FIG. 20 is a time chart of a voltage applied to a pixel capacitance.

In this example, a liquid crystal display apparatus of an active matrix driving system will be described.

Each pixel of the liquid crystal display apparatus of this example has a sample and hold circuit. As shown in FIG. 19, each pixel has the holding capacitance $C_H$ formed on a substrate as a capacitance element and a pixel capacitance $C_P$ including a liquid crystal provided as a display element. To one electrode of the holding capacitance $C_H$ is input a data signal via a switching element 51. This electrode of The holding capacitance $C_H$ is connected to the input terminal of a buffer amplifier 52. The switching element 51 is a circuit element which is controlled to be turned on/off by a scanning signal. The output terminal of the buffer amplifier 52 is connected to one electrode of the pixel capacitance $C_P$. This electrode of the pixel capacitance $C_P$ is connected to a ground line 54 via a switching element 53 and is connected to a recovery source line 56 via a switching element 55. The switching elements 53 and 55 are circuit elements which are controlled to be turned on/off by a response recovery signal. For example, when the response recovery signal is at a high level, the switching element 53 is on and the switching element 55 is off. When the response recovery signal is at a low level, the switching element 53 is on and the switching element 55 is on. The other electrodes of the holding capacitance $C_H$ and the pixel capacitance $C_P$ are connected to a common line 63.

The buffer amplifier 52 is an amplifier which is operated by using a high voltage source line 57 and the ground line 54 as power supplies and has a large input impedance and a small output impedance. When the potential of the high voltage source line 57 is taken as $V_{EE}$ and the potential of the ground line 54 is taken as GND, the potential $V_{COM}$ of the common line 63 is settled at an approximately medium value between the $V_{EE}$ and the GND. Therefore, the buffer amplifier 52 supplies a current from the high voltage source line 57 so that the pixel capacitance $C_P$ has a voltage in accordance with the voltage of the holding capacitance $C_H$, thereby charging the pixel capacitance $C_P$. The potential VR of the recovery source line 56 is settled to be the same as or smaller than the $V_{EE}$ and sufficiently larger than the $V_{COM}$.

At the beginning of each field, a response recovery signal whose level is changed between high and low at a rate of the cutoff frequency or more is sent to each of the pixels having the above-mentioned structure. Then, the switching elements 53 and 55 are alternately turned on and off repeatedly.

Figure 21:
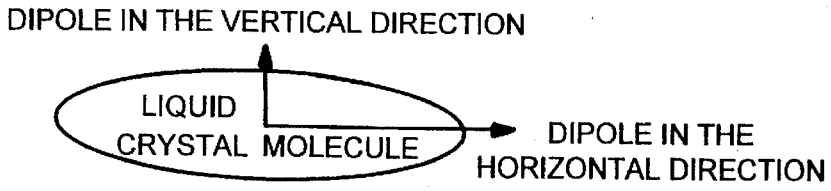
FIG. 21 shows the dipoles of a liquid crystal molecule.
Figure 22:
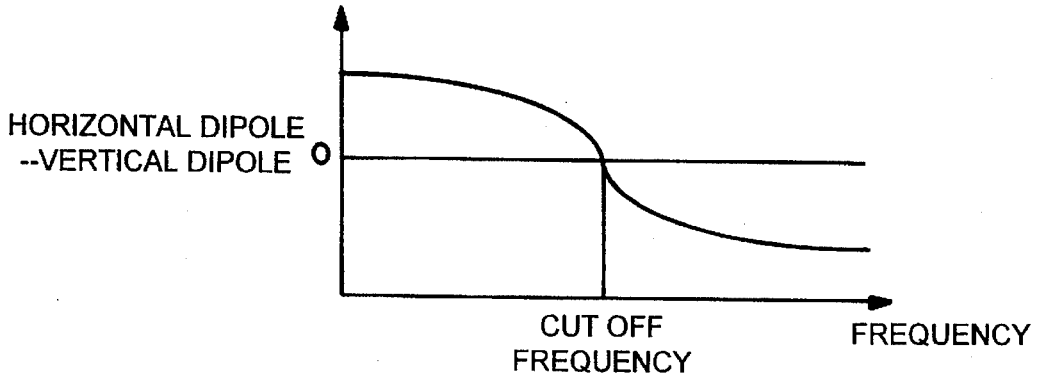
FIG. 22 shows the frequency characteristics of the dipoles of a liquid crystal molecule.

In a liquid crystal molecule used in an ordinary liquid crystal display apparatus, the dipole in the horizontal direction is larger than the dipole in the vertical direction as shown in FIG. 21. The frequency at which the dipole in the horizontal direction is equal to the dipole in the vertical direction is taken as a cutoff frequency as shown in FIG. 22. When an alternating current with a frequency higher than the cutoff frequency is applied to the liquid crystal, the recovery characteristic, i.e., the responding property, of the liquid crystal is improved. The cutoff frequency is several GHz in most of the liquid crystals generally used today, but a liquid crystal display apparatus having a cutoff frequency of several hundred kHz to several MHz can also be used.

Therefore, as mentioned above, the potential VR from the recovery source line 56 and the potential GND from the ground line 54 are alternately applied to the pixel capacitance $C_P$ as shown in FIG. 20. As a result, the liquid crystal which is applied with an electric field by the pixel capacitance $C_P$ can recover its responding property. Moreover, since the end of the response recovery signal is always at a high level, the pixel capacitance $C_P$ is discharged by the ground line 54 through the switching element 53.

Since the polarity of the data signal is changed in every field in this example, after discharging the pixel capacitance $C_P$ as described above, the data in the negative field is first displayed, for example, as shown in FIG. 20. In the negative field, the switching element 51 is turned on by activating a scanning signal, thereby supplying a data signal which is negative with regard to the potential $V_{COM}$ to the holding capacitance $C_H$ (for sampling), and holding the data signal by the holding capacitance $C_H$ by turning the switching element 51 off (for holding). Therefore, the switching element 51, the holding capacitance $C_H$ and the buffer amplifier 52 form the sample and hold circuit. Since the holding capacitance $C_H$ is formed as a capacitance element, a leak current is scarcely caused. Moreover, since the pixel capacitance $C_P$ is discharged, the buffer amplifier 52 supplies a current from the high voltage source line 57 so as to make the pixel capacitance $C_P$ have a voltage in accordance with the negative voltage of the holding capacitance $C_H$, thereby charging the pixel capacitance $C_P$. At this point, the data signal is always at a voltage level between the $V_{EE}$ and the GND. Therefore, the pixel capacitance $C_P$ whose voltage has once been decreased to the GND level can be thoroughly charged to a voltage level in accordance with the voltage of the data signal. When the display of the negative field is over in this manner, a response recovery signal is sent again, thereby recovering the responding property of the liquid crystal and discharging the pixel capacitance $C_P$. When the discharge of the pixel capacitance $C_P$ is finished, an image based on the data in the positive field is displayed. Also in the positive field, the switching element 51 is turned on by activating a scanning signal. A data signal which is positive with regard to the potential $V_{COM}$ is supplied to the holding capacitance $C_H$, thereby displaying the data in the positive field in the same manner as described above regarding the negative field.

As a result, in each pixel, the data signal supplied through the switching element 51 can be thoroughly held by the holding capacitance $C_H$. Whenever the voltage of the pixel capacitance $C_P$ is decreased due to leak current, the buffer amplifier 52 can compensate the decrease, thereby maintaining a clear display during the field period. Moreover, since the liquid crystal is recovered for the responding property in every positive and negative field, the degradation in the display quality caused by the degradation in the responding property of the liquid crystal can be avoided. Since the pixel capacitance $C_P$ is discharged, when a new data signal is supplied to each pixel, the voltage of the pixel capacitance $C_P$ can be thoroughly charged to a voltage in accordance with the new data signal by the unidirectional operation of the buffer amplifier 52 for supplying a current from the high voltage source line 57.

Example 8

Figure 23:
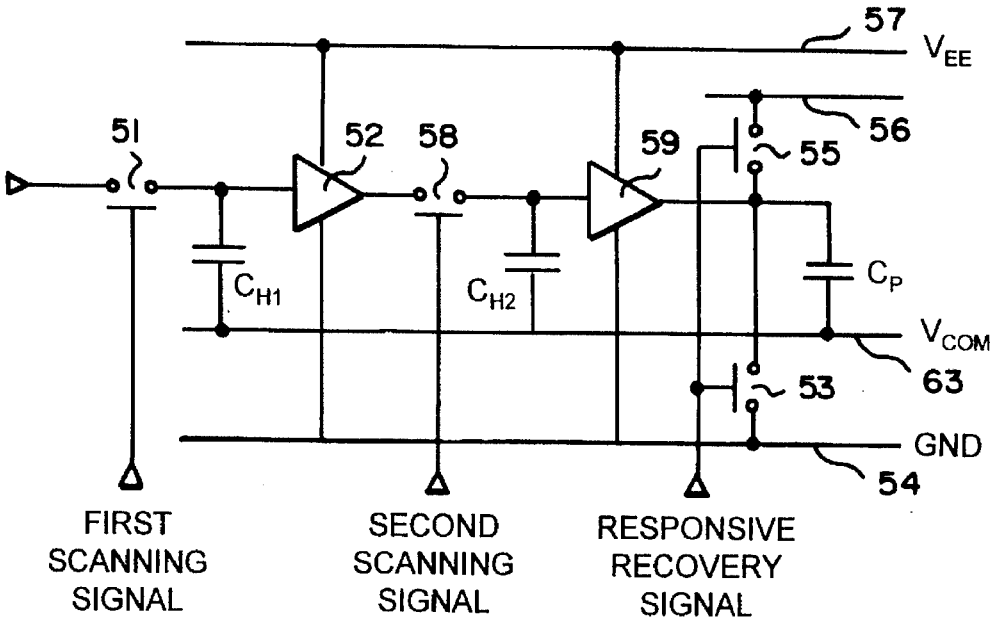
FIG. 23 is a circuit block diagram for the structure of a pixel according to Example 8 of this invention.

FIG. 23 is a circuit block diagram for a pixel of this example.

In this example, the sample and hold circuit of Example 7 shown in FIG. 19 is replaced with that of a master-slave system.

In this example, the sample and hold circuit of Example 7 is replaced with two pairs of sample and hold circuits, one of which includes the switching element 51, a first holding capacitance $C_{H1}$ and the buffer amplifier 52, and the other of which includes a switching element 58, a second holding capacitance $C_{H2}$ and a buffer amplifier 59. A data signal is supplied to the first holding capacitance $C_{H1}$ via the switching element 51. The output of the buffer amplifier 52 in accordance with the voltage of the first holding capacitance $C_{H1}$ is supplied to the second holding capacitance $C_{H2}$ via the switching element 58. The output of the buffer amplifier 59 in accordance with the voltage of the second holding capacitance $C_{H2}$ is supplied to the pixel capacitance $C_P$. The switching element 51 is controlled to be turned on/off by a first scanning signal, and the switching element 58 is controlled to be turned on/off by a second scanning signal. One electrode of the pixel capacitance $C_P$ is connected to the ground line 54 and the recovery source line 56 via the switching elements 53 and 55, respectively, as in Example 7.

In the pixel of Example 7 shown in FIG. 19, if the writing period when the switching element 51 is on is long, the electric charge of the pixel capacitance $C_P$ can not be rapidly changed. According to this example, however, the data signal supplied to each pixel is first held by the first holding capacitance $C_{H1}$ by activating a first scanning signal. After the first scanning signal is deactivated and a second scanning signal is activated, the buffer amplifier 52 charges the second holding capacitance $C_{H2}$ via the switching element 58, in response to which the pixel capacitance $C_P$ is charged by the buffer amplifier 59. Therefore, during the writing period when the first scanning signal is active and the switching element 51 is on, the voltage of the pixel capacitance $C_P$ is maintained by the second holding capacitance $C_{H2}$. As a result, the display based on the previous data signal can be maintained.

As a result, in this example, even when the writing period for supplying a data signal to a pixel is long, the display based on the previous data signal can be maintained during the writing period, and the electric charge of the pixel capacitance $C_P$ can be rapidly changed by a second scanning signal.

Example 9

Figure 24:
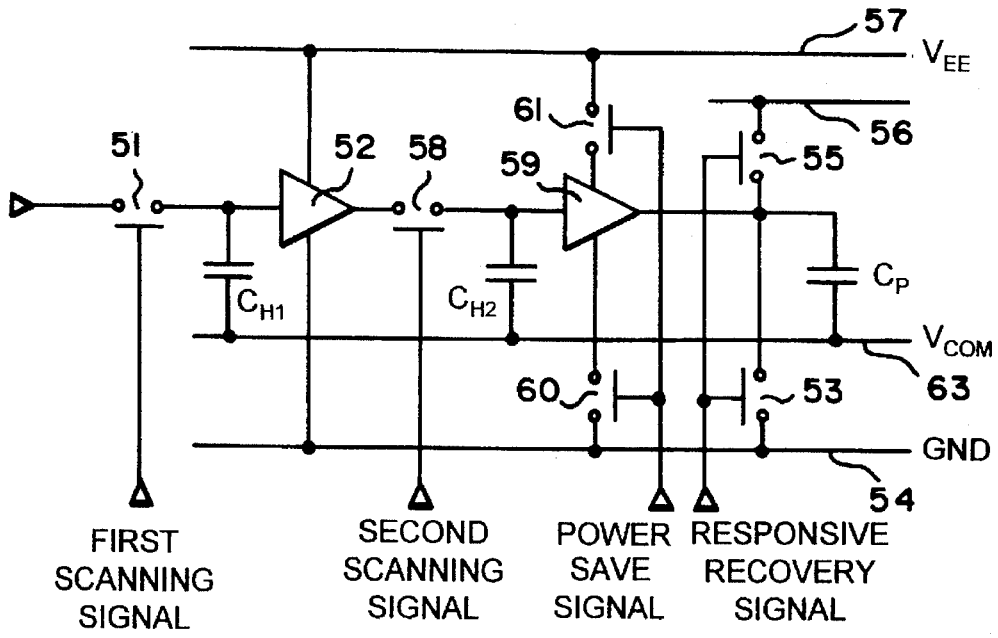
FIG. 24 is a circuit block diagram for the structure of a pixel according to Example 9 of this invention.

FIG. 24 is a circuit block diagram for a pixel of this example.

In this example, a circuit for decreasing the power loss is added to the circuit of Example 8 shown in FIG. 23. Switching elements 60 and 61, which are controlled to be turned on/off by a power save signal, are inserted between one power supply of the buffer amplifier 59 and the ground line 54 and between the other power supply of the buffer amplifier 59 and the high voltage source line 57, respectively.

In the Examples shown in FIGS. 19 and 23, when the switching elements 53 and 55 are alternately turned on/off by the response recovery system, an undesired current flows through the buffer amplifier 52 or 59. In this example, however, the buffer amplifier 59 can be cut off from the power supply by activating a power save signal during the response recovery. As a result, the power loss in the pixel can be decreased.

Example 10

Figure 25:
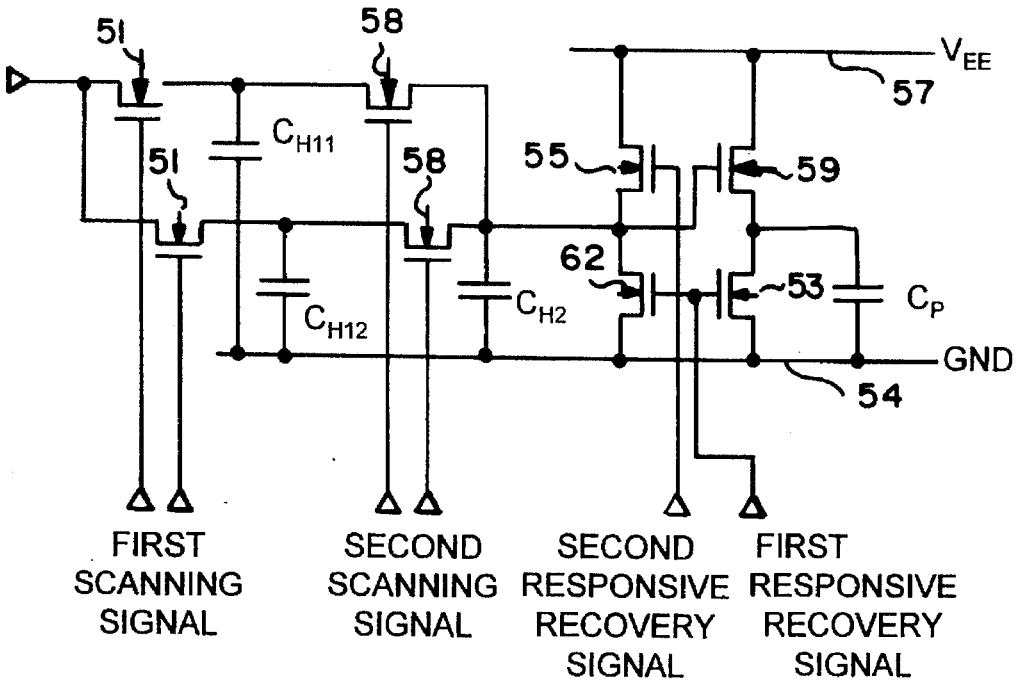
FIG. 25 is a circuit block diagram for the structure of a pixel according to Example 10 of this invention.

FIG. 25 is a circuit diagram for a pixel of this example.

All the transistors used in this example are formed from a N-channel MOSFET. Therefore, the response recovery signal is also divided into two types, a first response recovery signal for discharging and a second response recovery signal for charging. These two types of the response recovery signals are alternately activated. When the first response recovery signal is activated, one electrode of the pixel capacitance $C_P$ is connected to the ground line 54 via the switching element 53, and the gate terminal of the N-channel MOSFET in the buffer amplifier 59 is also connected to the ground line 54 via the switching element 62. As a result, an undesired current is prevented from flowing through the buffer amplifier 59. When the second response recovery signal is activated, the gate terminal of the N-channel MOSFET in the buffer amplifier 59 is connected to the high voltage source line 57 via the switching element 55, thereby charging the pixel capacitance $C_P$.

In this manner, in a pixel in which all the transistors are formed from a N-channel MOSFET, there is no need to form a well for a P-channel MOSFET on the silicon semiconductor substrate, resulting in a small circuit pattern area.

Moreover, in this example, the first holding capacitance $C_{H1}$ is divided into the first holding capacitances $C_{H11}$ and $C_{H12}$, thereby holding the positive data signals in one and the negative data signals in another. Further, the circuit of this example is simplified as compared with that of Example 8 by omitting the buffer amplifier 52 between the first holding capacitances $C_{H11}$ and $C_{H12}$ and the second holding capacitance $C_{H2}$. However, when the buffer amplifier 52 is omitted as in this example, the electric charge of the first holding capacitances $C_{H11}$ and $C_{H12}$ is distributed to the second holding capacitance $C_{H2}$. Therefore, in order to avoid the influence of the degradation in the voltage, it is necessary to make the capacitance of the second holding capacitance $C_{H2}$ sufficiently smaller than the capacitances of the first holding capacitances $C_{H11}$ and $C_{H12}$.

As is apparent from the above description, a display apparatus according to any of Examples 7 to 10 can provide a practical circuit in which a leak current from a pixel capacitance is compensated by using a holding capacitance and a buffer amplifier so as to maintain a clear display for a long period of time and prevent degradation in the responding property of a liquid crystal.

Figure 26:
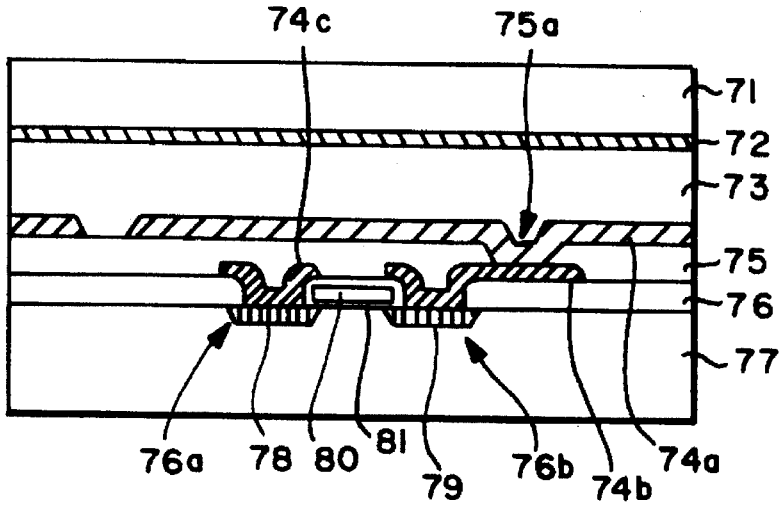
FIG. 26 is a sectional view of an example of the structure of the liquid crystal display apparatus of this invention.

FIG. 26 is a sectional view of an example of the structure of the liquid crystal display apparatus according to this invention. The liquid crystal display apparatus of FIG. 26 utilizes a silicon gate MOS transistor as a switching element.

This liquid crystal display apparatus includes a single crystal silicon substrate 77 and a field silicon oxide film 76 disposed on the single crystal silicon substrate 77. The field silicon oxide film 76 has throughholes **76*a* and 76*b*. Aluminum electrodes 74*b* and 74*c* are formed on inside and bottom surfaces of the throughholes 76*a* and 76*b* and on the field silicon oxide film 76 in the vicinity of upper peripheries of the throughholes 76*a* and 76*b*, respectively. The single crystal silicon substrate 77 has a source area 79 below the aluminum electrode 74*c* and a drain area 78 below the aluminum electrode 74*b***.

A gate insulating film 81 and a gate electrode 80 are disposed between the throughholes **76*a* and 76*b*. The gate electrode 80 is covered with a silicon oxide film or the like to avoid shortcircuiting with the aluminum electrodes 74*b* and 74*c*. Although the gate electrode 80** is formed of polysilicon in this example, other materials can be used.

The aluminum electrodes **74*b* and 74*c* and the field silicon oxide film 76 are covered with a protective film 75 for protecting the MOS switching circuit. The protective film 75 has a throughhole 75*a* above the aluminum electrode 74*b*. Inside and bottom surfaces of the throughhole 75*a* and the protective film 75 are superposed by a reflective film 74*a* also acting as an electrode. Although the reflective film 74*a* is formed of aluminum having a high reflectance in this example, other materials can be used. In order to reduce resistance caused by the contact of the reflective film 74*a* and the aluminum electrode 74*b*, heat processing should be conducted after the reflective film 74*a* is formed. However, the heat processing roughens the surface of the reflective film 74*a* to lower the reflectance thereof. For the purpose of smoothing the surface of the reflective film 74*a* to improve the reflectance thereof, a surface rubbing and smoothing process is conducted after the protective film 75** is formed and again after the above-mentioned heat processing is finished.

An orientation film (not shown) is formed on the reflective film 74*a*. The orientation film is formed by coating a polyimide resin on the entire top surface of the silicon substrate 77 bearing the reflective film 74*a*, and then heating and rubbing the coated resin. A transparent electrode 72 is formed of ITO on a glass substrate 71 by sputtering. Another orientation film (not shown) is then formed on the transparent electrode 72.

A sealing resin is coated on the peripheral area of the display portion of either the silicon substrate 77 bearing the components such as a circuit, or the glass substrate 71 bearing the transparent electrode 72. After opposing these two substrates 71 and 77 to each other, the sealing resin is cured. A gap between the substrates 71 and 77 adhered to each other in this manner is filled with a liquid crystal material 73. In a display apparatus of a quick response system, the liquid crystal material and the display mode to be used are preferably those that can be used in the quick response system. The display material used in the present invention is not limited to a liquid crystal but includes any materials having characteristics similar to those of a liquid crystal.

Since a single crystal silicon substrate is used in this example, the techniques in the field of IC are applicable in this display apparatus. Namely, various highly developed frontier techniques such as a fine processing technique, a method for forming a thin film with a high quality, a method for introducing an impurity with high accuracy, a technique for controlling a crystal defect, a production and design method for a device or a circuit, and a CAD technique are applicable. Therefore, a pixel can be further refined by using a fine processing technique for IC, thereby realizing a highly refined display which has not been attained until now.

Figure 27:
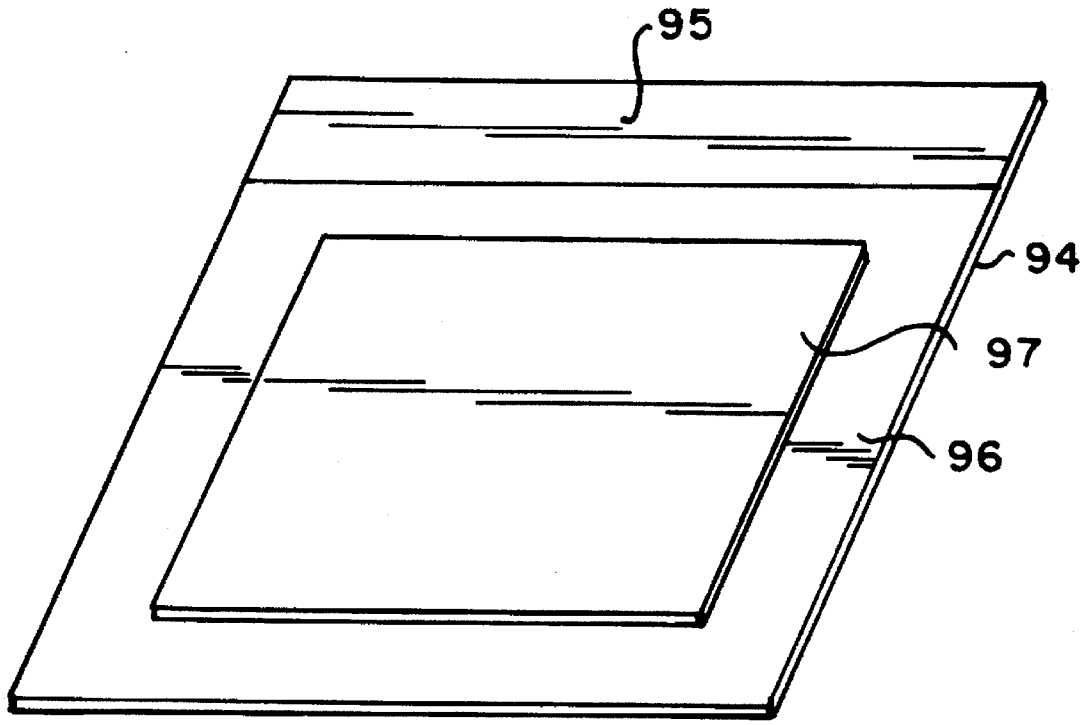
FIG. 27 is a schematical view of the structure of the liquid crystal display apparatus of this invention.

FIG. 27 is a schematic view of the structure of the liquid crystal display apparatus of this invention. The apparatus shown in this figure includes a driving circuit, a data processing circuit such as an A/D transducer and a data level corrective circuit, and a memory circuit formed thereon. These circuits are provided separately from the display panel in a conventional display apparatus.

In this liquid crystal display apparatus, a single crystal silicon substrate 94 is adhered to a glass substrate 97 having the glass substrate 97 positioned in the center of the single crystal silicon substrate 94. A gap between the substrates 94 and 97 is filled with a liquid crystal material (not shown). On the surface of the single crystal silicon substrate 94 facing the glass substrate 97, a LSI circuit including a switching element and the like is formed. FIG. 26 shows the sectional view of an example of such a surface bearing a LSI circuit.

Figure 28:
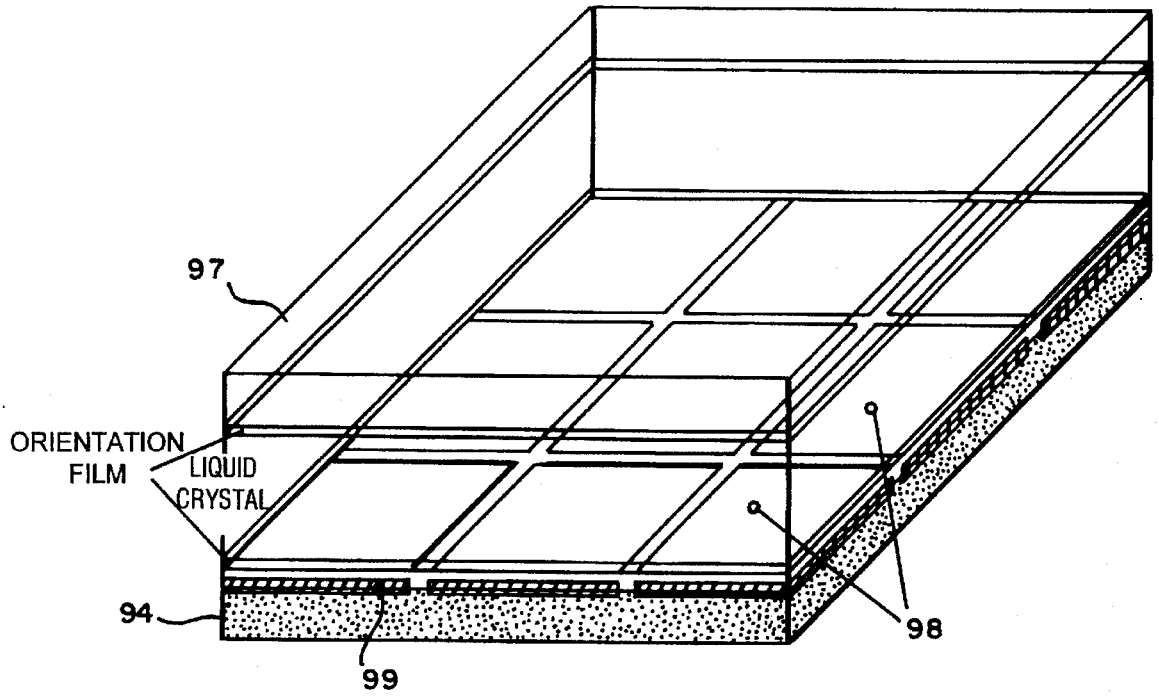
FIG. 28 is a perspective view for showing the position of a LSI circuit in the liquid crystal display apparatus of this invention.
Figure 29:
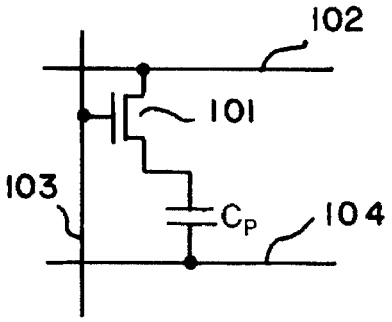
FIG. 29 is a circuit block diagram for the structure of a conventional pixel.
Figure 30:
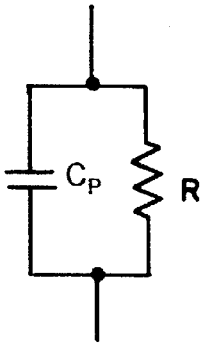
FIG. 30 is a circuit diagram of the conventional pixel.
Figure 31:
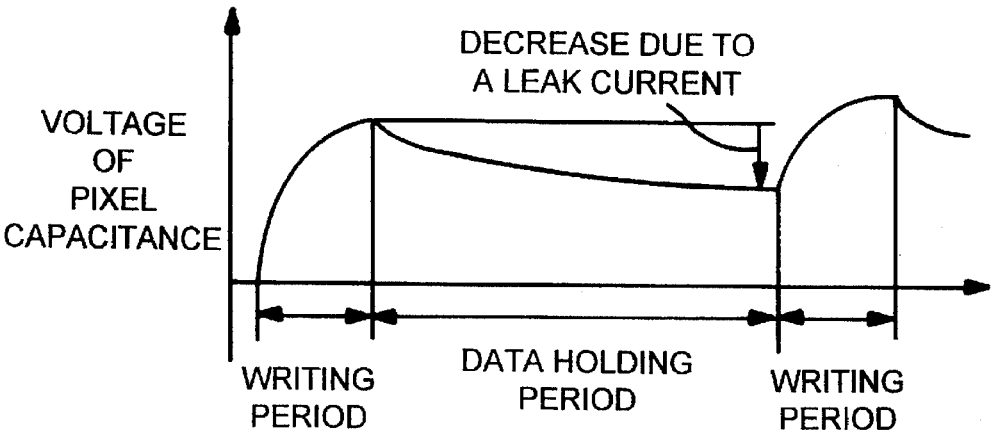
FIG. 31 is a time chart of a voltage of a conventional pixel capacitance.
Figure 32:
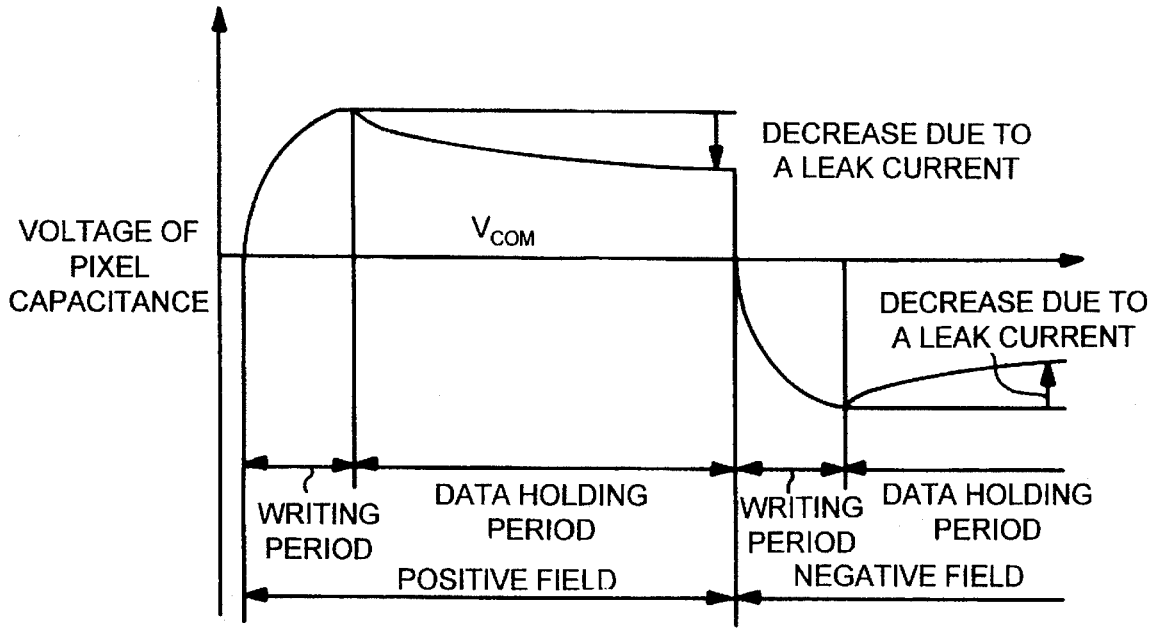
FIG. 32 is a time chart of a voltage of a conventional pixel capacitance in a display apparatus of an alternating driving system.
Figure 33:
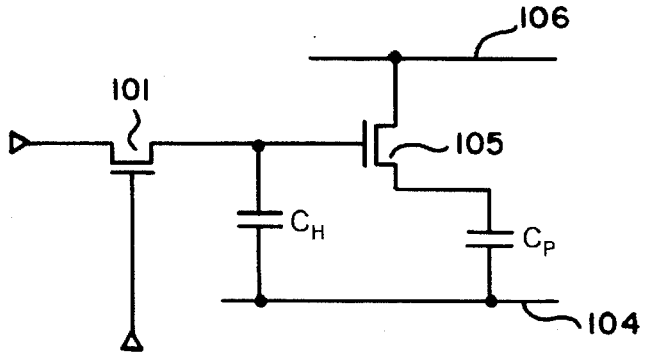
Fig. 33 (Prior Art)
FIG. 33 is a circuit diagram of a conventional pixel including a sample and hold circuit.

FIG. 28 shows the position of the LSI circuit. In the display apparatus shown in this figure, a matrix of pixels is formed on the single crystal silicon substrate 94, and each pixel is provided with a reflective film 98. A LSI circuit 99 is formed between the single crystal silicon substrate 94 and each of the reflective films 98. The LSI circuit 99 is specifically any of the circuits described in the above examples.

A driving circuit 96 includes a scanning signal line driver, a data signal line driver and the like, and mainly includes a circuit for driving a switching element in each pixel. Specifically, the driving circuit 96 includes circuits for generating a scanning signal, a data signal, a refresh signal and various selecting signals, and timing control circuits required for the generation of these signals.

The data processing circuit is formed in a signal processing area 95. A circuit formed in the signal processing area 95 and the structure thereof can be modified depending upon the function of the liquid crystal display apparatus or can be omitted.

The substrate used in the display apparatus is not limited to the single crystal silicon substrate described above, but includes any other substrate.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A display apparatus comprising:

a plurality of pixels, each of which is supplied with a pixel data;

a pixel capacitance for accumulating an electric charge in accordance with the pixel data;

a holding capacitance provided to each of the pixels to hold the pixel data;

a buffer amplifying means for supplying the electric charge to the pixel capacitance in accordance with a voltage of the holding capacitance, wherein the buffer amplifying means is a bidirectional amplifying means for supplying positive and negative charges to pixel capacitance in accordance with a voltage of the holding capacitance;

a charging load means having a load connected in parallel with the pixel capacitance, wherein the pixel capacitance is supplied with the positive and negative electric charges by the bidirectional amplifying means, and the positive and negative electric charges pass through the charging load means via the load; and a charging load control means for connecting the charging load means in parallel with the pixel capacitance during a charge supply period including at least a predetermined period from a start of supplying positive and negative electric charges based on a new pixel data from the bidirectional amplifying means to the pixel capacitance, and for cutting off the charging load means from the pixel capacitance during any period except for the charge supply period.

2. A display apparatus according to claim 1 further comprising a responsive recovery switching means for repeatedly applying positive and negative voltages alternately to the pixel capacitance by a response recovery signal.

3. A display apparatus according to claim 1 further comprising a means connected between a common line and a ground line, both of which are connected to the buffer amplifying means, for preventing a current flowing between the common line and the ground line through the buffer amplifying means.

4. A display apparatus according to claim 1, wherein all transistors used in an area where the plurality of the pixels are formed are of one kind selected from the group consisting of P-channel and N-channel.

5. A display apparatus comprising:

a plurality of pixels, each of which is supplied with a pixel data;

a pixel capacitance for accumulating an electric charge in accordance with the pixel data;

a first holding capacitance provided to each of the pixels to hold the pixel data;

a display changing means which is controlled to be turned on/off by a display changing signal;

a second holding capacitance which is supplied with the electric charge by the first holding capacitance via the display changing means;

a buffer amplifying means for supplying the electric charge to the pixel capacitance in accordance with a voltage of the second holding capacitance, and wherein the buffer amplifying means is a bidirectional amplifying means for supplying positive and negative charges to the pixel capacitance in accordance with a voltage of the second holding capacitance.

6. A display apparatus according to claim 5 further comprising a charging load means having a load connected in parallel with the pixel capacitance, wherein the pixel capacitance is supplied with the positive and negative electric charges by the bidirectional amplifying means, and the positive and negative electric charges passes through the charging load means via the load.

7. A display apparatus according to claim 6 further comprising a charging load control means for connecting the charging load means in parallel with the pixel capacitance during a charge supply period including at least a predetermined period from a start of supplying positive and negative electric charges based on a new pixel data from the bidirectional amplifying means to the pixel capacitance, and for cutting off the charging load means from the pixel capacitance during any period except for the charge supply period.

8. A display apparatus according to claim 5 further comprising a pixel data selecting means provided between a switching element and a data line for supplying the pixel data, the switching element being connected between the first holding capacitance and the data line.

9. A display apparatus according to claim 5 further comprising a refresh switching means which is controlled to be turned on/off by a refresh signal, wherein the pixel capacitance is connected to a power supply for discharging via the refresh means.

10. A display apparatus according to claim 5 further comprising a responsive recovery switching means for repeatedly applying positive and negative voltages alternately to the pixel capacitance by a response recovery signal.

11. A display apparatus according to claim 5 further comprising a means connected between a common line and a ground line, both of which are connected to the buffer amplifying means, for preventing a current flowing between the common line and the ground line through the buffer amplifying means.

12. A display apparatus according to claim 5, wherein a capacitance of the second holding capacitance is sufficiently smaller than a capacity of the first holding capacitance.

13. A display apparatus according to claim 5 further comprising a second buffer amplifying means connected between the first holding capacitance and the second holding capacitance.

14. A display apparatus according to claim 5, wherein all transistors used in an area where the plurality of the pixels are formed are of one kind selected from the group consisting of P-channel and N-channel.

15. A display apparatus comprising:

a plurality of pixels, each of which is supplied with a pixel data;

a pixel capacitance for accumulating an electric charge in accordance with the pixel data;

a holding capacitance provided to each of the pixels to hold the pixel data;

a buffer amplifying means for supplying the electric charge to the pixel capacitance in accordance with a voltage of the holding capacitance, wherein the buffer amplifying means is a bidirectional amplifying means for supplying positive and negative charges to pixel capacitance in accordance with a voltage of the holding capacitance; and a charging load means having a load connected in parallel with the pixel capacitance, wherein the pixel capacitance is supplied with the positive and negative electric charges by the bidirectional amplifying means, and the positive and negative electric charges pass through the charging load means via the load, and wherein the charging load means includes a P-channel transistor and an N-channel transistor, which are controlled by signals whose polarities are different from each other.

16. A display apparatus according to claim 15 further comprising a charging load control means for connecting the charging load means in parallel with the pixel capacitance during a charge supply period including at least a predetermined period from a start of supplying positive and negative charges based on a new pixel data from the bidirectional amplifying means to the pixel capacitance, and for cutting off the charging load means from the pixel capacitance during any period except for the charge supply period.

17. A display apparatus according to claim 15 further comprising a responsive recovery switching means for repeatedly applying positive and negative voltages alternately to the pixel capacitance by a response recovery signal.

18. A display apparatus according to claim 15 further comprising a means connected between a common line and a ground line, both of which are connected to the buffer amplifying means, for preventing a current flowing between the common line and the ground line through the buffer amplifying means.

19. A display apparatus according to claim 15, wherein all transistors used in an area where the plurality of the pixels are formed are of one kind selected from the group consisting of P-channel and N-channel.

20. A display apparatus comprising:

a plurality of pixels, each of which is supplied with a pixel data;

a pixel capacitance for accumulating an electric charge in accordance with the pixel data;

a holding capacitance provided to each of the pixels to hold the pixel data;

a buffer amplifying means for supplying the electric charge to the pixel capacitance in accordance with a voltage of the holding capacitance;

a responsive recovery switching means for repeatedly applying positive and negative voltages alternately to the pixel capacitance by a response recovery signal;

wherein the buffer amplifying means is a bidirectional amplifying means for supplying positive and negative charges to pixel capacitance in accordance with a voltage of the holding capacitance;

a charging load means having a load connected in parallel with the pixel capacitance, wherein the pixel capacitance is supplied with the positive and negative electric charges by the bidirectional amplifying means, and the positive and negative electric charges pass through the charging load means via the load; and a charging load control means for connecting the charging load means in parallel with the pixel capacitance during a charge supply period including at least a predetermined period from a start of supplying positive and negative electric charges based on a new pixel data from the bidirectional amplifying means to the pixel capacitance, and for cutting off the charging load means from the pixel capacitance during any period except for the charge supply period.

* * * * *